US007385570B2

(12) United States Patent
Kang et al.

(10) Patent No.: US 7,385,570 B2
(45) **Date of Patent: *Jun. 10, 2008**

(54) METHOD AND APPARATUS FOR DRIVING PANEL BY PERFORMING MIXED ADDRESS PERIOD AND SUSTAIN PERIOD

(75) Inventors: Kyoung-Ho Kang, Suwon (KR); Woo-Joon Jeong, Asan (KR); Hak-Ki Choi, Cheonan (KR); Seung-Hun Chae, Suwon (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

This patent is subject to a terminal disclaimer.

(21) Appl. No.: 11/354,005

(22) Filed: Feb. 15, 2006

(65) Prior Publication Data

US 2006/0125729 A1 Jun. 15, 2006

Related U.S. Application Data

(62) Division of application No. 10/400,466, filed on Mar. 28, 2003.

(30) Foreign Application Priority Data

Nov. 26, 2002 (KR) ..... 2002-0074108

(51) Int. Cl.
*G09G 3/28* (2006.01)

(52) U.S. Cl. ..... 345/68; 345/60; 345/63; 345/89; 345/690

(58) Field of Classification Search ..... 345/60–89, 345/204–215, 690–699
See application file for complete search history.

(56) References Cited

U.S. PATENT DOCUMENTS 5,541,618 A 7/1996 Shinoda
5,724,054 A 3/1998 Shinoda
5,786,794 A 7/1998 Kishi et al.
6,097,357 A 8/2000 Shinoda et al.
6,177,922 B1 1/2001 Schiefer et al.
6,219,012 B1 4/2001 Holtslag
6,340,960 B1 1/2002 Song et al. ..... 345/60

(Continued)

FOREIGN PATENT DOCUMENTS

EP 0 674 303 B1 4/1997

(Continued)

*Primary Examiner*—Vijay Shankar
(74) *Attorney, Agent, or Firm*—H.C. Park & Associates, PLC

(57) ABSTRACT

A display device for displaying pictures by sequentially performing an address period and a sustain period. The panel pixels are arranged into groups, and an address period and a sustain period are sequentially performed on the pixels of individual groups. While an address period is being performed on the pixels of a group, the pixels of other groups are idle. While a sustain period is being performed on the pixels of the group subsequent to the address period, a sustain period is selectively performed on the pixels of other groups that have already undergone an address period. Accordingly, a sustain discharge operation is performed within a short time after an address operation is performed on the pixels, so that a stable sustain discharge occurs even though narrow scan pulses and address pulses may be applied during the address operation. Also, the time required to address all pixels is reduced.

3 Claims, 19 Drawing Sheets

U.S. PATENT DOCUMENTS

| | | | | |
|---|---|---|---|---|
| 6,424,325 | B1 | 7/2002 | Van Dijk | |
| 6,456,265 | B1 | 9/2002 | Mikoshiba et al. | |
| 6,483,491 | B1 | 11/2002 | Lee | |
| 6,496,194 | B1 | 12/2002 | Mikoshiba et al. | |
| 6,512,499 | B1 | 1/2003 | Abe | |
| 6,630,916 | B1 | 10/2003 | Shinoda | |
| 7,053,870 | B2 * | 5/2006 | Shoji et al. | 345/60 |
| 2002/0000955 | A1 | 1/2002 | Derkson et al. | |
| 2002/0027535 | A1 | 3/2002 | Van Dijk | |
| 2002/0067320 | A1 | 6/2002 | Holtslag et al. | |
| 2003/0151565 | A1 | 8/2003 | Kim et al. | |
| 2003/0174150 | A1 | 9/2003 | Ohe et al. | |
| 2003/0179162 | A1 | 9/2003 | Ooe et al. | |
| 2004/0100425 | A1 | 5/2004 | Kang et al. | |
| 2004/0160392 | A1 | 8/2004 | Kim et al. | |

FOREIGN PATENT DOCUMENTS

| | | |
|---|---|---|
| JP | 08-044315 | 2/1996 |
| JP | 2001-184022 | 7/2001 |
| JP | 2002-108281 | 4/2002 |
| KR | P1999-00065832 | 8/1999 |

* cited by examiner

METHOD AND APPARATUS FOR DRIVING PANEL BY PERFORMING MIXED ADDRESS PERIOD AND SUSTAIN PERIOD

CROSS REFERENCE TO RELATED APPLICATIONS

This application is a divisional application of application Ser. No. 10/400,466, filed on Mar. 28, 2003, which claims priority to and the benefit of Korean Patent Application No. 2002-74108, filed on Nov. 26, 2002, which are both hereby incorporated by reference for all purposes as if fully set forth herein.

BACKGROUND OF THE INVENTION

1. Field of the Invention

The present invention relates to a display device, especially for a device displaying pictures by sequentially executing an address period and a sustain period, such as, a plasma display panel (PDP).

2. Description of the Related Art

A panel driving timing can be divided into a reset (initialization) period, an address (write) period, and a sustain (display) period. In the reset period, all the cells in the panel are initialized so that each of the cells can be properly addressed. In the address period, wall charges are accumulated on cells to be lit from a panel. After addressing all the cells of the panel, in the sustain period, a discharge for picture display actually takes place on the addressed cells simultaneously. Such a driving method is well described in U.S. Pat. No. 5,541,618.

The U.S. Pat. No. 5,541,618 discloses a method for driving a PDP that performs an address operation and a sustain operation separately in time, when displaying a gradation using a sub-field scheme within a frame. In other words, after all scan electrodes are completely addressed, a sustain operation is executed concurrently on all the pixels. According to this driving method, a sustain-discharge operation does not start until the last scan line finishes an address operation. This wastes significantly long time until a sustain discharge occurs on the addressed cells, which may cause an unstable sustain discharge.

SUMMARY OF THE INVENTION

The present invention provides a method and an apparatus for driving a flat panel display, which smoothes a sustain discharge by minimizing interval between an address period and a sustain period.

The present invention achieves such objects, advantages and features by addressing and sustain-discharging by a group. The present invention divides the pixels into a group. Within one sub-field, a write/sustain mixed period sequentially performs an address operation and a sustain operation on the pixels of each of the groups. First, an address operation is performed on the pixels of a first group, and a sustain operation is then performed on the pixels of the first group that was addressed. The sustain operation is followed by another address operation on the pixels of a second group. This process is repeated. In other words, while a sustain operation is being performed on the pixels of a certain group, other groups that have already gone through an address operation are also subject to sustain operations. After the write/sustain mixed period, all the pixels of all the groups go through a concurrent sustain period that performs a sustain operation concurrently on all the pixels for a certain period of time. Thereafter, in a brightness compensation period the present invention selectively subjects certain groups of pixels to an additional sustain operation in order to satisfy a predetermined gradation.

The present invention is not limited to the above-described methods. Different variations of such methods and an apparatus that implements such methods are also disclosed.

One of ordinary skill in the art would appreciate the scope and spirit of the present invention and the present invention is not limited to the disclosure described herein but includes all variations and equivalents under the sprit and scope of the disclosure.

BRIEF DESCRIPTION OF THE DRAWINGS

The above and other features and advantages of the present invention will become more apparent by describing in detail exemplary embodiments thereof with reference to the attached drawings.

DETAILED DESCRIPTION OF THE INVENTION

Figure 1A:
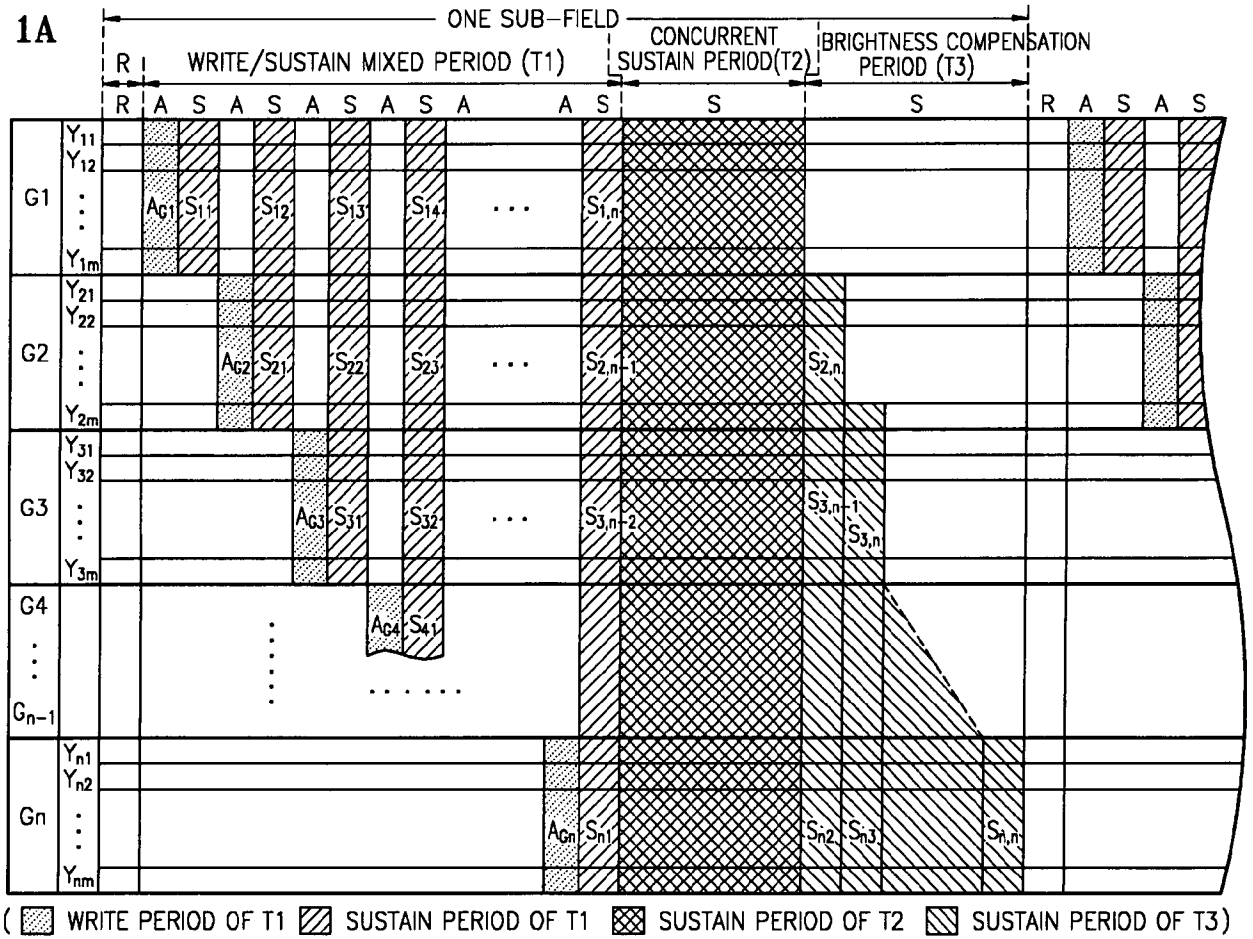
FIGS. 1A and 1B are schematic diagram illustrating a method for driving a display panel according to a first embodiment of the present invention.

According to an aspect of the present invention, provided is a panel driving method in which the pixels of a panel are classified into a plurality of groups and addressed and sustain-discharged on a group-by-group basis. In the panel driving method, a write/sustain mixed period sequentially performs an address period and a sustain period on the pixels of each of the groups. In the write/sustain mixed period, an address period is performed on the pixels of each of the groups, and a sustain period is then performed on the pixels of the addressed group. The sustain period is followed by an address period for the pixels of the next group. While a sustain period is being performed on the pixels of a certain group, other groups that have already undergone an address period are also subjected to sustain periods. After the write/sustain mixed period, a brightness compensation period selectively performs an additional sustain period on the pixels of each of the groups in order to equalize brightness levels differentiated due to different lengths of sustain periods performed on individual groups during the write/sustain mixed period. Thereafter, a concurrent sustain period performs a predetermined length of sustain period concurrently on the pixels of all of the groups in order to obtain a predetermined gradation.

According to an aspect of the present invention, there is also provided a panel driving method in which the pixels of a panel are classified into a plurality of groups and addressed and sustain-discharged on a group-by-group basis. The panel driving method is performed by sequentially performing an address period and a sustain period on the pixels of each of the groups. To be more specific, after a sequence of an address period and a sustain period is performed on the pixels of a group, an address period is performed on the pixels of the next group. While a sustain period is being performed on the pixels of a group, a sustain period is selectively performed on the pixels of each of other groups that have already undergone an address period. If a predetermined gradation is obtained by the sustain periods performed until now for the latter group, the latter group maintains an idle state even though the former group undergoes a sustain period. After the pixels of all of the groups have completely undergone address periods and sustain periods, an additional sustain period for obtaining the predetermined gradation is selectively performed on the pixels of each of groups that do not satisfy the predetermined gradation.

According to an aspect of the present invention, there is also provided a panel driving method in which the pixels of a panel are classified into a plurality of groups and addressed and sustain-discharged on a group-by-group basis. In the panel driving method, first, an address operation is performed by applying scan pulses sequentially to the scan electrodes of a first group. Next, a sustain operation is performed by applying sustain pulses to the scan electrodes. Thereafter, an address operation and a sustain operation are performed on the scan electrodes of a second group after the sustain operation on the first group has been completed. Then, an address operation and a sustain operation are performed on all of the groups in a sequence of the first to last groups in the same manner.

According to an aspect of the present invention, there is also provided a panel driving method in which the pixels of a panel are classified into a plurality of groups and addressed and sustain-discharged on a group-by-group basis. In the panel driving method, while an address period is being performed on the pixels of a group, the pixels of other groups are idle. While a sustain period is being performed on the pixels of the group subsequent to the address period, a sustain period is selectively performed on the pixels of each of other groups that have already undergone an address period.

According to another aspect of the present invention, there is provided a panel driving apparatus including a signal synthesis unit and a pixel driving unit. The signal synthesis unit includes an address signal generator to generate an address signal for selectively addressing pixels to be lit and a sustain signal generator to generate a sustain signal for sustain-discharging the pixels addressed by the address signal generator. The pixel driving unit drives the pixels of the individual groups according to the address and sustain signals output from the signal synthesis unit. The signal synthesis unit generates the address and sustain signals so as to sequentially perform an address period and a sustain period on the pixels of each of the groups in such a way that, while an address period is being performed on the pixels of a group, the pixels of other groups are idle, and while a sustain period is being performed on the pixels of the group subsequent to the address period, a sustain period is selectively performed on the pixels of each of other groups that have already undergone an address period.

Figure 7:
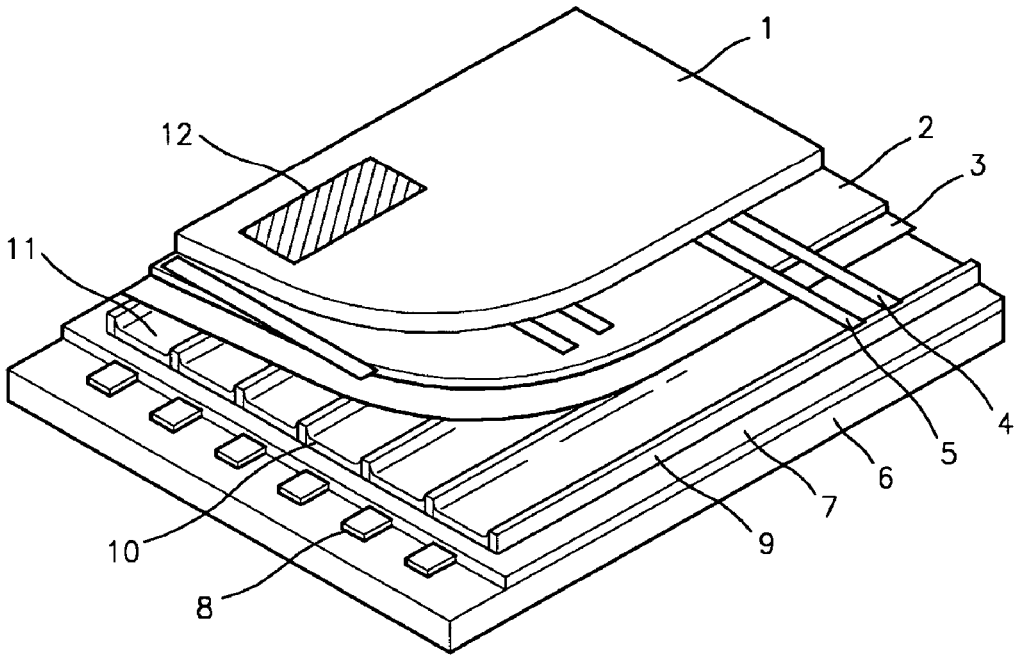
FIG. 7 is a partial perspective view of an AC-type PDP.

Referring to FIG. 7, an AC-type PDP has a scan electrode 4 and a sustain (common) electrode 5 paired together. They are covered with a dielectric layer 2 and a protective layer 3, and disposed in parallel on a first glass substrate 1. A plurality of address electrodes 8 are disposed on a second glass substrate 6. They are covered with an isolation layer 7. A partition wall 9 is disposed on the isolation layer 7. The partition wall 9 is laid in parallel with the address electrodes 8. A phosphor 10 fills the spaces defined by the surface of the isolation layer 7 and the sides of the partition walls 9. The first glass substrate 1 and the second glass substrate 6 are put together, leaving a discharge space 11 therebetween. They are arranged to have the scan electrodes 4 and the sustain electrodes 5 cross the address electrodes 8 at a right angle. A portion of the discharge space 11 where an address electrode 8 intersects a pair of a scan electrode 4 and a sustain electrode 5 forms a discharge cell 12.

Figure 8:
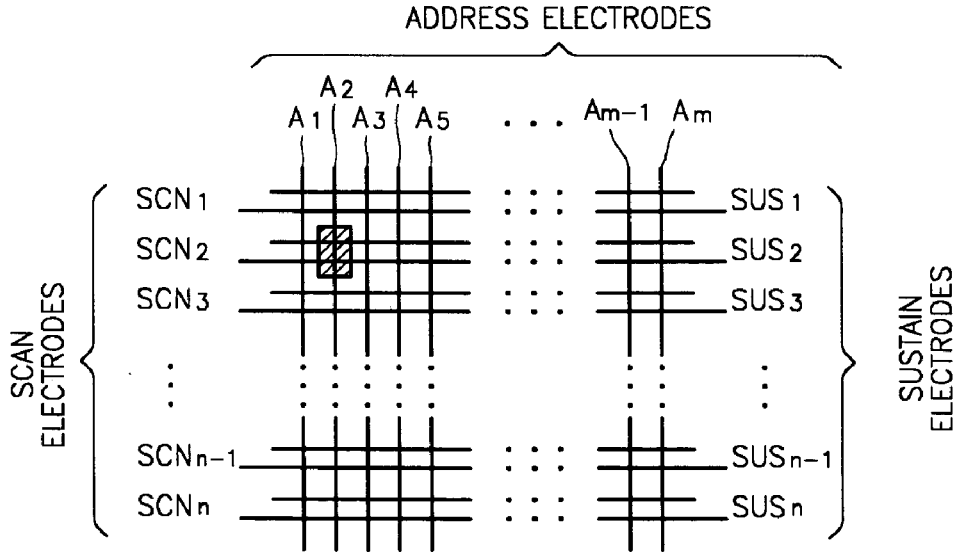
FIG. 8 is a schematic diagram showing electrodes of a display panel.

FIG. 8 shows a schematic view of electrode arrangement in its panels. Electrodes are formed in a m×n matrix. Address electrodes $A_1$ through $A_m$ are arranged in the row direction. N scan electrodes of $SCN_1$ through $SCN_n$ and n sustain electrodes of $SUS_1$ through $SUS_n$ are disposed in the column direction. A discharge cell shown in FIG. 8 corresponds to the discharge cell 12 of FIG. 7.

Figure 9:
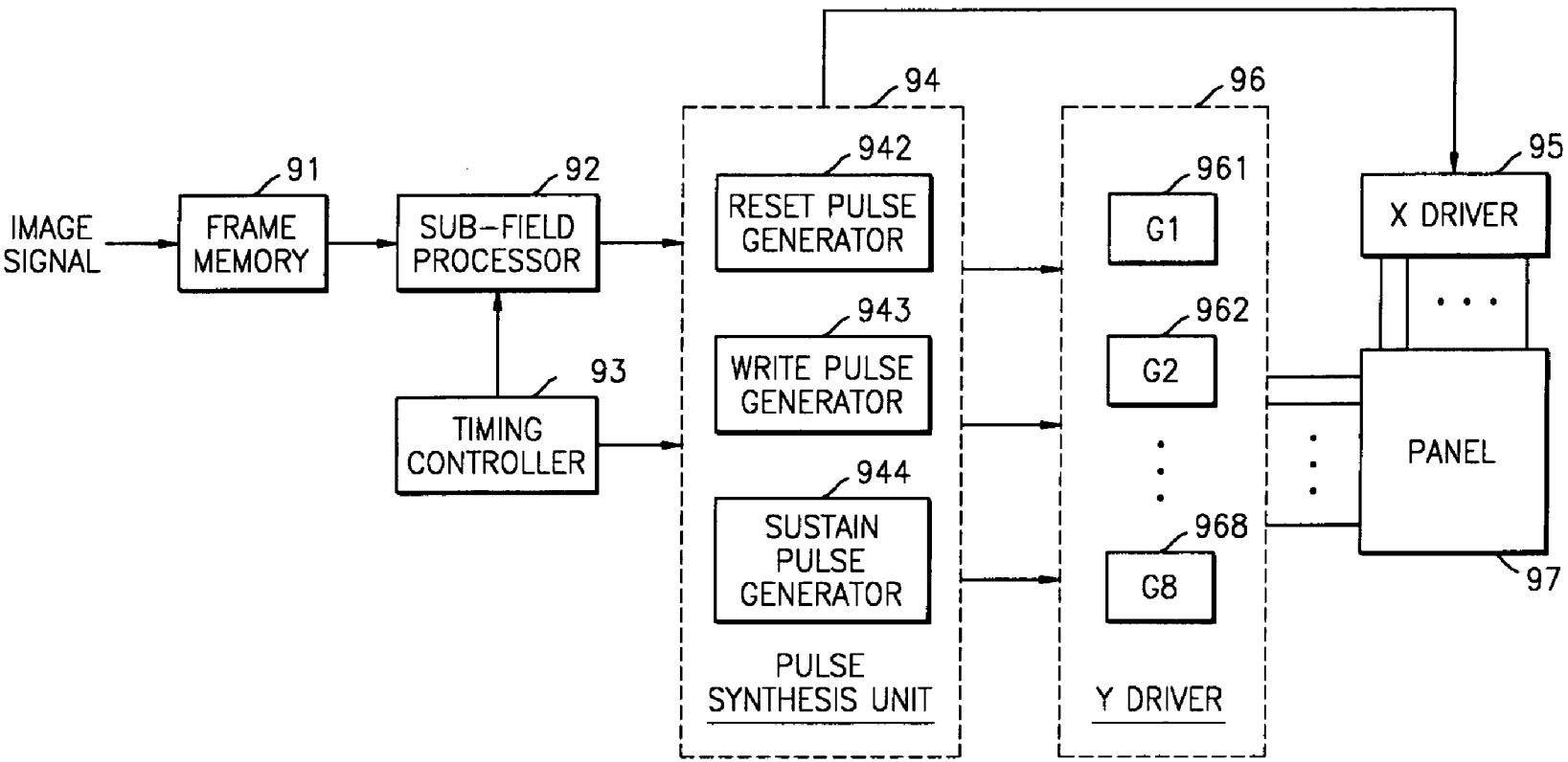
FIG. 9 is a block diagram of a panel driving apparatus according to the present invention.

FIG. 9 is a block diagram of a panel driving apparatus according to an embodiment of the present invention. An analog image signal to be displayed on a panel 97 is converted into a digital image signal and recorded in a frame memory 91. A sub-field processor 92 divides digital data stored in the frame memory 91 into sub-fields as necessary and outputs a sub-field at one time. For example, to represent a gradation on the panel 97, a single frame of pixel data stored in the frame memory 91 is divided into a plurality of sub-fields, and data of individual sub-field are output.

In order to drive address electrodes, scan electrodes, and sustain electrodes that form the pixels of the panel 97, a pulse synthesis unit 94 includes a reset pulse generator 942, a write pulse generator 943, and a sustain pulse generator 944 for generating signals to be applied to the above three types of electrodes during a reset period, during an address period, and during a sustain period, respectively. The reset pulse generator 942 generates a reset pulse for resetting the state of each cell. The write pulse generator 943 generates address pulses for selectively addressing cells to be lit. The sustain pulse generator 944 generates sustain pulses for discharging the cells addressed by the address pulses. A signal generated by the pulse synthesis unit 94 is applied to a scan electrode (Y) driver 96 and a sustain electrode (X) driver 95 in accordance with a predetermined timing.

The scan electrodes (Y) of the panel 97 are arranged into a plurality of groups G1 through G8. The Y driver 96 includes a plurality of driving circuits 961 through 968 for driving the scan electrodes belonging to the groups G1 through G8, respectively. Meanwhile, the X driver 95 drives the sustain electrodes of the panel 97. A timing controller 93 generates various timing signals necessary for operating the sub-field processor 92 and the pulse synthesis unit 94.

A method for driving a display panel according to various embodiments of the present invention will now be described, referring to the structure and device illustrated in FIGS. 7, 8 and 9. In other words, a process of dividing a frame into sub-fields and sequentially performing an address operation and a sustain operation on each of the sub-fields, or a process of sequentially performing an address operation and a sustain operation on a plurality of groups can be easily implemented in the device of FIG. 9.

FIG. 1A illustrates a method for driving a panel according to an embodiment of the present invention. The pixels of a panel are arranged into a plurality of groups, and the pixels are addressed and sustained by a group.

The scan electrodes of a panel are classified into a plurality of groups $G_1$ through $G_n$, and the scan electrodes belonging to each of the groups $G_1$ through $G_n$ are sequentially addressed. After one group is addressed, sustain discharge pulses are applied to the electrodes of the group to perform a sustain operation. When the electrodes of a certain group undergo a sustain operation, the addressed electrodes in the other groups may also selectively undergo a sustain operation. As described above, after an address operation and a sustain operation are sequentially performed on the pixels of a certain group, an address operation is performed on the scan electrodes of other groups that have not yet been addressed. Here, when the scan electrodes of a panel are arranged into a plurality of groups, the number of scan electrodes belonging to each group may be set to be equal to or different from each other.

In FIG. 1A, a single sub-field can be formed of a reset period R, a write/sustain mixed period T1, a concurrent sustain period T2, and a brightness compensation period T3. In FIG. 1A, a dotted block indicates a write (address) period of the write/sustain mixed period T1, a left-hatched block indicates a sustain period of the write/sustain mixed period T1, a left-right hatched block indicates a sustain period of the concurrent sustain period T2, and a right-hatched block indicates a sustain period of the brightness compensation period T3.

The reset operation R resets the state of a wall charge of pixels by applying reset pulses to the scan lines of all the groups. Instead of concurrently performing a reset operation on all the groups, a reset operation may be performed on individual groups before an address operation is performed on the pixels of each of the groups.

Figure 1B:
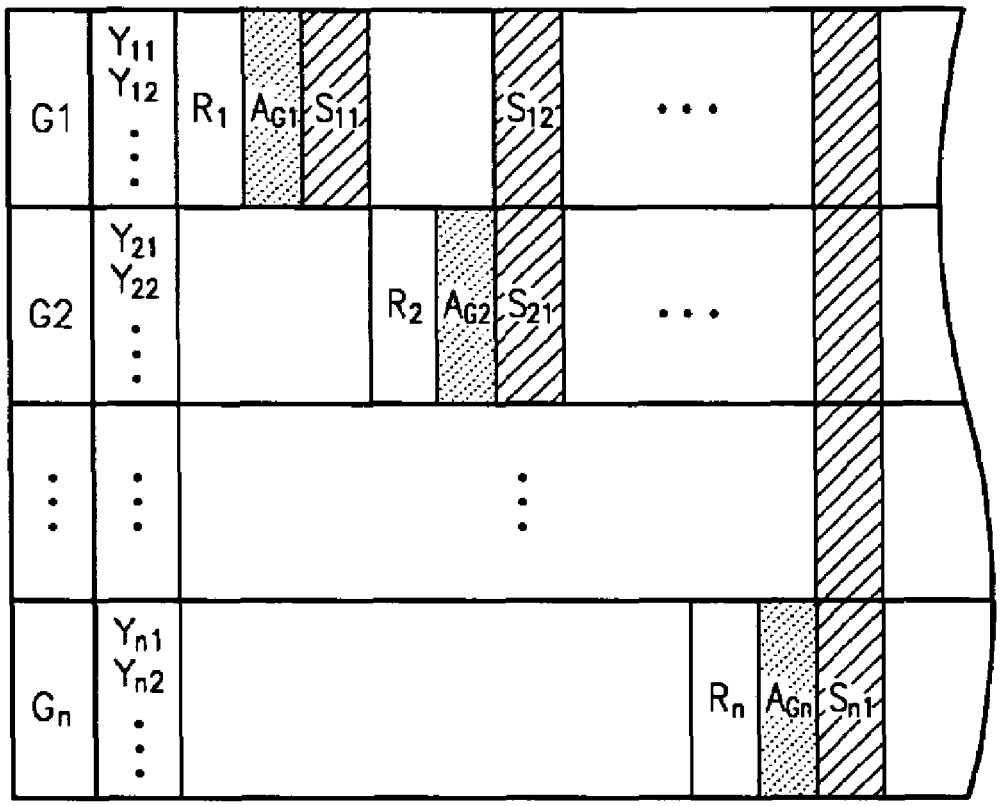

FIG. 1B illustrates reset operations performed on individual groups, where an address operation and a sustain operation are performed in the same way as illustrated in FIG. 1A. As shown in FIG. 1B, after a first reset period $R_1$ is performed on the pixels of the first group G1, an address period $A_{G1}$ and a sustain period $S_{11}$ are performed on the pixels of the first group G1. After the sustain period $S_{11}$, a second reset period $R_2$ is performed on the pixels of the second group G2. Then, an address period $A_{G2}$ is performed on the second group G2, and subsequently sustain periods $S_{12}$ and $S_{21}$ are concurrently performed on the pixels of the first group G1 and the second group G2.

Looking at the write/sustain mixed period T1, an address period $A_{G1}$ is performed by applying scan pulses to the first scan line $Y_{11}$ through the m-th scan line $Y_{1m}$ of the first group G1 in sequence. After the pixels of the first group are all completely addressed, a sustain period $S_{11}$ is performed to sustain and discharge the addressed pixels using a predetermined number of sustain pulses.

After the sustain period $S_{11}$ is completed on the first group G1, an address period $A_{G2}$ is performed on the pixels of the second group G2. Preferably, during the address period $A_{G2}$ for the second group G2, sustain pulses are not applied to the pixels of other groups. However, it is possible that, after a scan pulse is applied to a scan electrode in the second group and before a next scan pulse is applied to the next scan electrode in the second group, sustain pulses may be applied to the electrodes of other groups. The address period can be performed for the other groups in the same manner.

If an address period $A_{G2}$ for the second group G2 is completed, that is, when the scan electrodes of the second group G2 are completely addressed, a first sustain period $S_{21}$ for the second group G2 is performed. At this time, the first group that has already been addressed is subject to a second sustain period $S_{12}$. Until then, the second sustain period $S_{12}$ may not be performed on the first group. Undoubtedly, the pixels that have not yet undergone an address period are idle.

If the first sustain period $S_{21}$ of the second group has been concluded, an address period $A_{G3}$ and a first sustain period $S_{31}$ are performed on the third group in the same way as described above. During the first sustain period $S_{31}$ performed on the third group, sustain periods $S_{13}$ and $S_{22}$ may be performed on the pixels of the first group G1 and the second group G2 that have already been addressed.

Through this process, an address period $A_{Gn}$ is performed by applying scan pulses to the scan electrodes of the last group Gn in a sequence from the first electrode $Y_{n1}$ to the last electrode $Y_{nm}$. Then, a sustain period $S_{n1}$ is performed on the last group Gn. During the sustain period $S_{n1}$, sustain periods may also be performed on the pixels of other groups.

FIG. 1A illustrates a method of the present invention. While an address period is performed on the pixels of a certain group, the pixels of all the groups that have already been addressed are also subject to a sustain period. If the number of sustain pulses applied during a single sustain period for each group is equal for individual groups, that is, if a brightness revealed by the sustain pulses applied during a single sustain period is equal for individual groups, the pixels of the first group G1 provide a brightness n times greater than the brightness provided by the n—th group Gn. The pixels of the second group G2 provide a brightness (n−1) times greater than the brightness provided by the n—th group Gn. The pixels of the (n−1)th group Gn−1 provide a brightness twice as much as the brightness provided by the n-th group Gn. This describes the write/sustain mixed period T1.

The write/sustain mixed period T1 is followed by the concurrent sustain period T2. During the concurrent sustain period T2, a sustain period is performed by applying sustain pulses concurrently to the pixels of all the groups.

The concurrent sustain period T2 is followed by the brightness compensation period T3. During the brightness compensation period T3, an additional sustain period is performed on individual groups in order to equalize different brightness values that are obtained due to different lengths of sustain periods performed on the individual groups. For example, the brightness of the first group G1 is determined by the sum of the sustain periods $S_{11}$, $S_{12}$, . . . , and $S_{1n}$ performed over the write/sustain mixed period T1 and the concurrent sustain period T2. The pixels of the first group G1 provide the highest brightness at the point of time when the brightness compensation period T3 starts. The other groups can have the brightness of the first group by performing an additional sustain period $S_{2n}$ on the pixels of the second group G2 and performing additional sustain periods $S_{3(n-1)}$ and $S_{3n}$ on the pixels of the third group G3. Here, the sustain period $S_{2n}$ corresponds to the first sustain period $S_{11}$ for the first group, and the sustain periods $S_{3(n-1)}$ and $S_{3n}$ correspond to the first sustain period $S_{11}$ and the second sustain period $S_{12}$ for the first group, respectively. Finally, additional sustain periods $S_{n2}$, $S_{n3}$, . . . , and $S_{nn}$ must be performed on the pixels of the n-th group Gn. This process allows all the pixels that constitute a panel have an equivalent brightness level.

As described above, if sustain periods for all the pixels are completed, one sub-field is completely driven, and then a reset period of the next sub-field starts.

In FIG. 1A, a single sub-field can be divided into three sessions having different characteristics.

In the write/sustain mixed period T1, sustain periods are performed while addressing all the pixels of a panel. Write/sustain mixed period T1 is where address periods and sustain periods are mixed in a time flow. During the write/sustain mixed period T1, a sequence of an address period and a sustain period is repeated on the pixels of each group. Also, after a sequence of an address period and a sustain period is performed on the pixels of a certain group, an address period for the pixels of the next group starts. Furthermore, while a sustain period is performed on the pixels of a certain group, sustain periods are performed on the pixels of other groups that have already been addressed.

The concurrent sustain period T2 denotes a time domain where a predetermined length of a sustain period is performed concurrently on all the pixels. The brightness compensation period T3 denotes a time domain where the different brightness levels of individual groups are compensated by performing an additional sustain period on selected individual groups. Consequently, the gradations of the individual groups are matched with each other to obtain a predetermined gradation.

In the example of FIGS. 1A and 1B, sustain periods for applying sustain pulses appear in the write/sustain mixed period T1, the concurrent sustain period T2, and the brightness compensation period T3. Preferably, sustain pulses applied during the sustain period of the write/sustain mixed period T1 are wider than or have higher voltage than those applied during the concurrent sustain period T2. This can accumulate more sufficient wall changes for each of the pixels after an address operation.

Figure 2A:
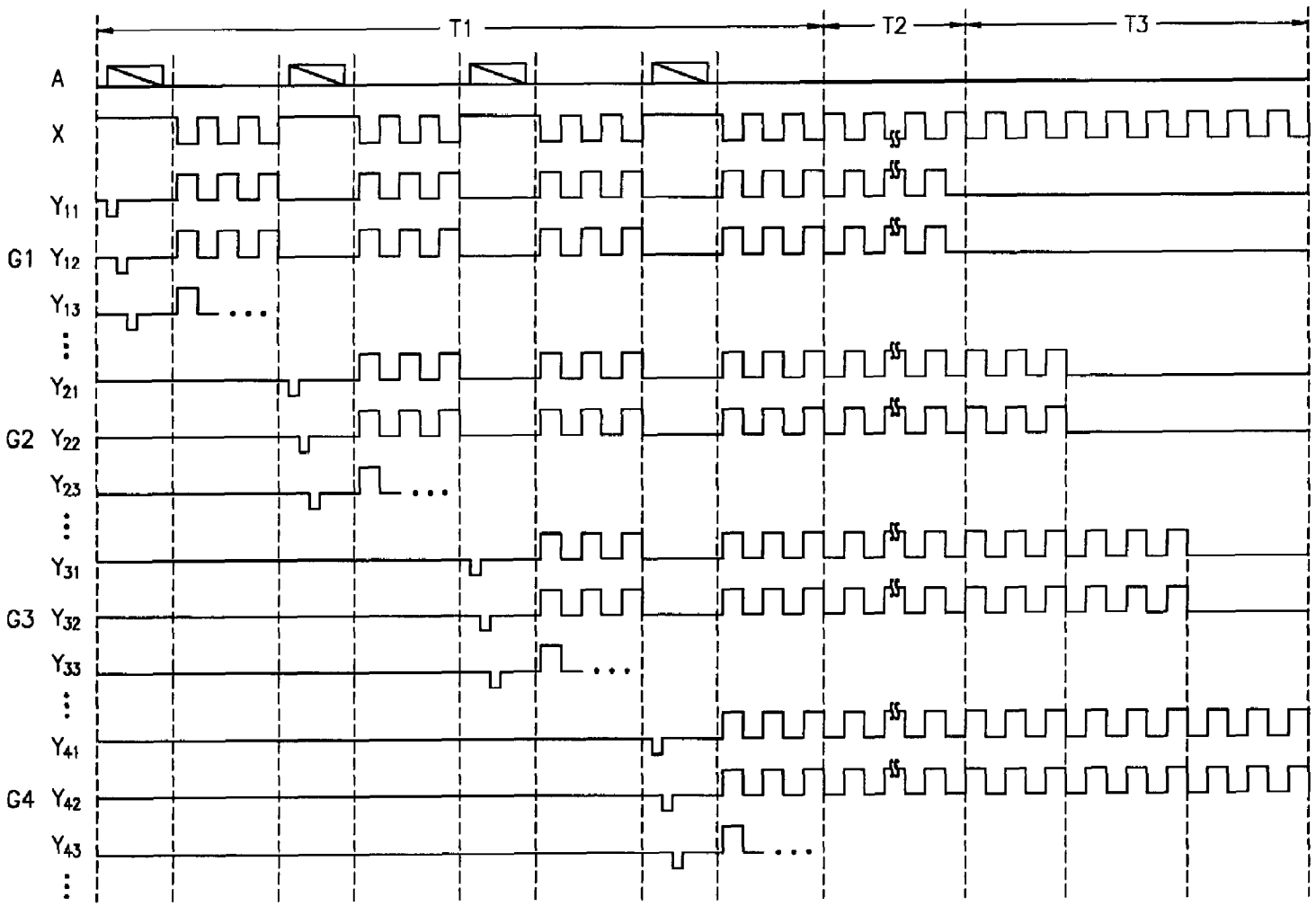
FIG. 2A is a timing chart of the method illustrated in FIGS. 1A and 1B when applied to an AC-type PDP.

FIG. 2A illustrates an example where the method for driving a panel as described in FIGS. 1A and 1B is applied to an AC-type PDP. During the write/sustain mixed period T1, when scan pulses are sequentially applied to scan electrodes $Y_{11}$, $Y_{12}$, . . . that belong to the first group G1, addressing occurs according to the relationship between the scan pulses and the address pulses applied to address electrodes A. If all of the scan electrodes of the first group G1 are completely addressed, an address period for the first group G1 is terminated, and sustain discharge pulses are applied to common electrodes X and scan electrodes Y in order to perform a sustain period on all of the pixels of the first group G1.

For convenience of explanation, FIG. 2A shows application of three pairs of sustain pulses during one sustain period. Preferably, sustain pulses, the number of which is enough to sustain and discharge addressed pixels, are applied. For example, in order to represent a gradation of 256 grades, it is preferable that sustain pulses, the number of which is required to represent at least one grade, are applied during a single sustain period. Meanwhile, sustain pulses can only be applied to the common electrodes X belonging to a group for which a sustain period is to be performed. Also, if sustain pulses are applied to the common electrodes X, but no sustain pulses are applied to the scan electrodes Y, sustain discharge does not occur in the pixels. Accordingly, sustain pulses may be applied to the common electrodes X of all of the groups.

After concluding an address period and a sustain period for the first group, an address period and a sustain period are performed on the second group. During the sustain period for the second group, the first group also undergoes a sustain period. The duration or the number of sustain pulses of sustain periods subsequent to address periods for the first group is not necessarily equal to that of the sustain period performed on the second group.

In the above-described way, an address period and a sustain period are sequentially performed on the pixels of the fourth group G4. Thereafter, the concurrent sustain period T2 and the brightness compensation period T3 follow in sequence. During the concurrent sustain period T2, a sustain period is performed on the pixels of all the groups. During the brightness compensation period T3, additional sustain periods are performed to equalize the brightness levels of individual groups.

Figure 2B:
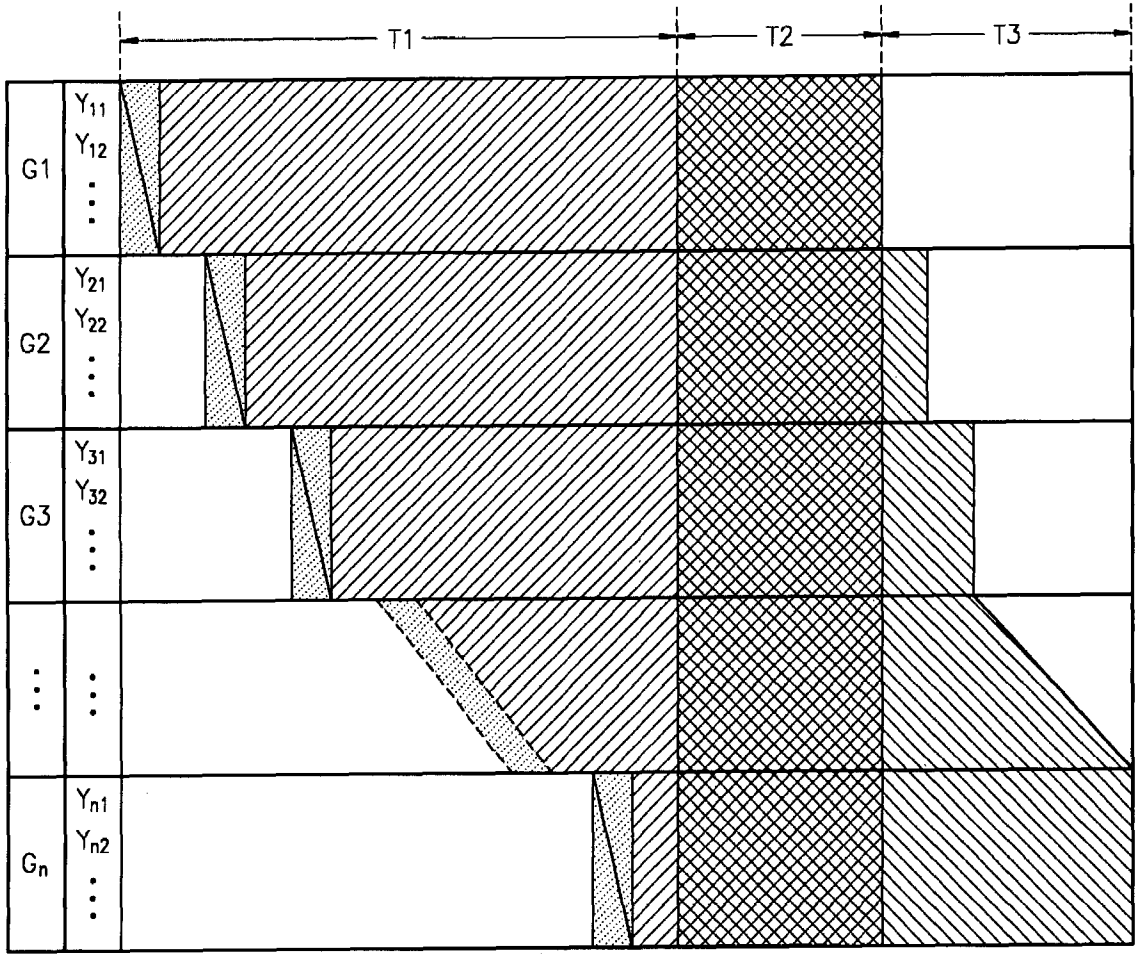
FIG. 2B conceptually illustrates the method for driving a display panel according to the present invention.

FIG. 2B conceptually illustrates the method for driving the panel according to the present invention. During the write/sustain mixed period T1, the pixels of a panel are classified into a plurality of groups, and the individual groups sequentially undergo an address period in such a way that a sustain operation is performed for the pixels of at least one group between an address period for a certain group and an address period for the next group. Accordingly, it can be seen from the timing relationship that sustain periods are performed while all the scan lines of the panel are sequentially addressed. After completing the write/sustain mixed period T1 in the above-described way, the concurrent sustain period T2 comes for all the pixels of the panel. Finally, the brightness compensation period T3 follows, selectively performing additional sustain operations on the individual group.

Figure 3A:
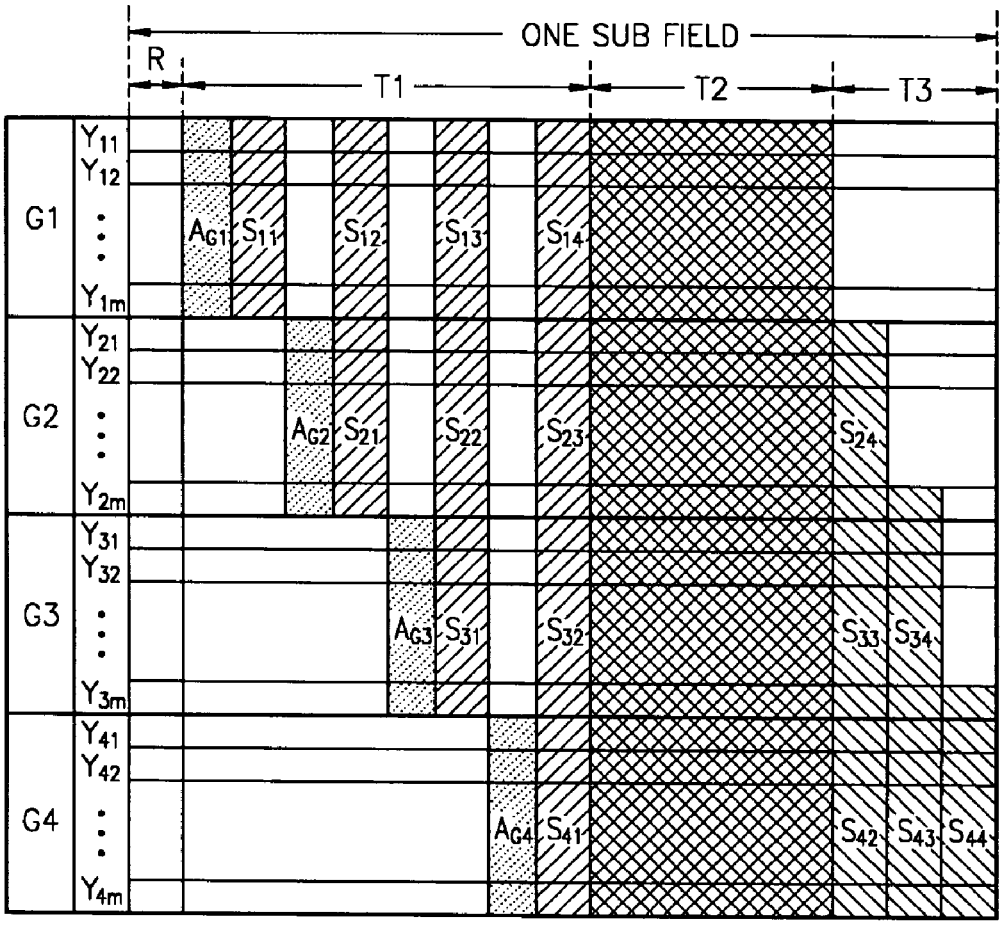
FIGS. 3A and 3B illustrate two exemplary methods driving a display panel according to the present invention when pixels of the display panel are arranged into four groups.

FIG. 3A illustrates a way in which the method for driving a panel according to the present invention is performed when the pixels of a panel are arranged into four groups. A sub-field comprises a reset period R, a write/sustain mixed period T1, a concurrent sustain period T2, and a brightness compensation period T3, which are operated in the manner as described above.

A plurality of scan electrodes that constitute a panel can be classified into a plurality of groups by grouping the scan electrodes by a predetermined number of sequential scan electrodes. If a panel is formed of 800 scan lines, the 800 scan lines are divided into 8 groups in such a way that first through $100^{th}$ scan lines are arranged into a first group, and $101^{st}$ through $200^{th}$ scan lines are arranged into a second group. Alternatively, the scan lines may be grouped in such a way that scan lines spaced from each other at intervals can be divided into a group. For example, first, ninth, seventeenth, . . . , and (8k+1)th scan electrodes are arranged into a first group. Second, tenth, eighteenth, . . . , and (8k+2)th scan electrodes are arranged into a second group. The scan lines may also be grouped in an arbitrary and irregular way.

If non-adjacent scan lines are arranged into a group and a sustain period is performed subsequent to an address period for the scan electrodes of a certain group, priming occurs due to a sustain-discharge and drives charges to move to adjacent scan lines. Such priming may contribute to an address operation on the adjacent scan lines. If the first group has undergone an address period and a sustain period, charges due to a priming caused by the sustain discharge operation on the first group are generated on the second, tenth, . . . , and (8k+2)th scan lines adjacent to the first, ninth, . . . , and (8k+1)th scan lines in the first group. In this case, the second group can be more certainly addressed when the second group is turned to be addressed.

Figure 3B:
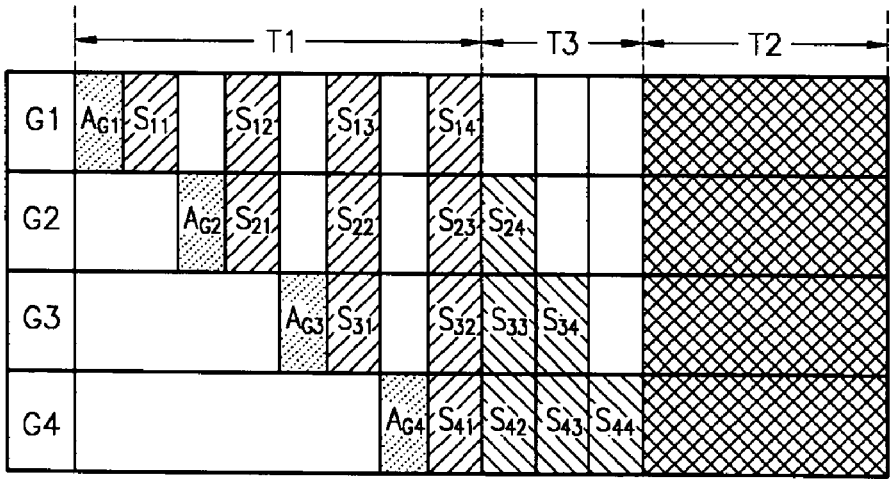

FIG. 3B illustrate another way different from FIG. 3A. In FIG. 3B, a brightness compensation period T3 is performed before a concurrent sustain period T2. In other words, after a write/sustain mixed period T1, the brightness compensation period T3 is performed to compensate for different brightness levels of individual groups to match the brightness levels of all pixels. After the brightness compensation period T3, a concurrent sustain period T2 is performed on all the pixels, thereby obtaining a desired gradation. In other words, the brightness compensation period T3 is selectively performed on the individual groups in order to equalize the brightness levels of the groups differentiated due to different lengths of sustain periods performed on the groups during the write/sustain mixed period T1. During the concurrent sustain period T2, a predetermined length of sustain period is performed concurrently on all the groups to obtain a desired gradation.

Figure 4A:
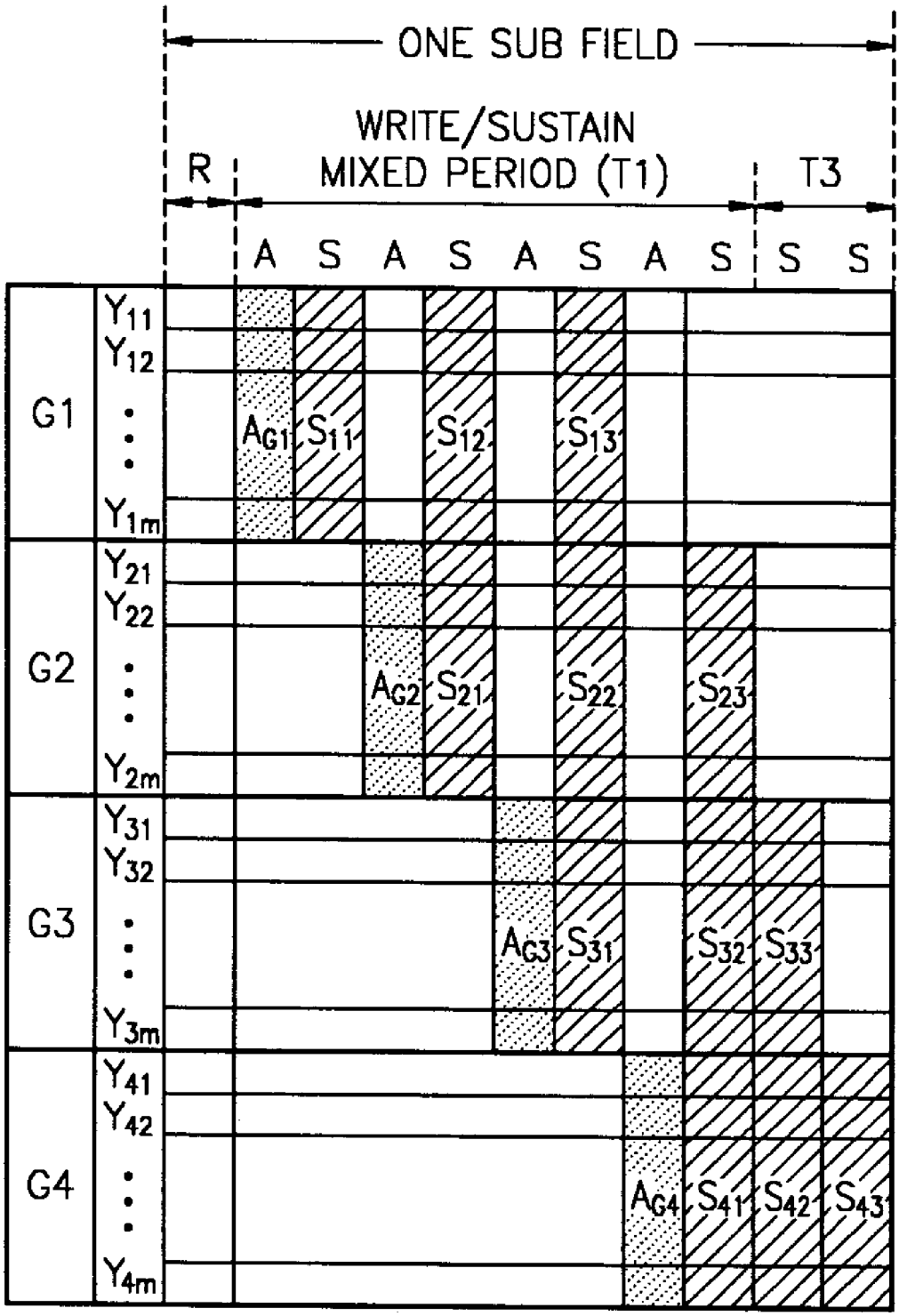
FIGS. 4A, 4B, and 4C are timing diagrams for illustrating various examples of the method for driving a display panel according to the present invention.
Figure 4B:
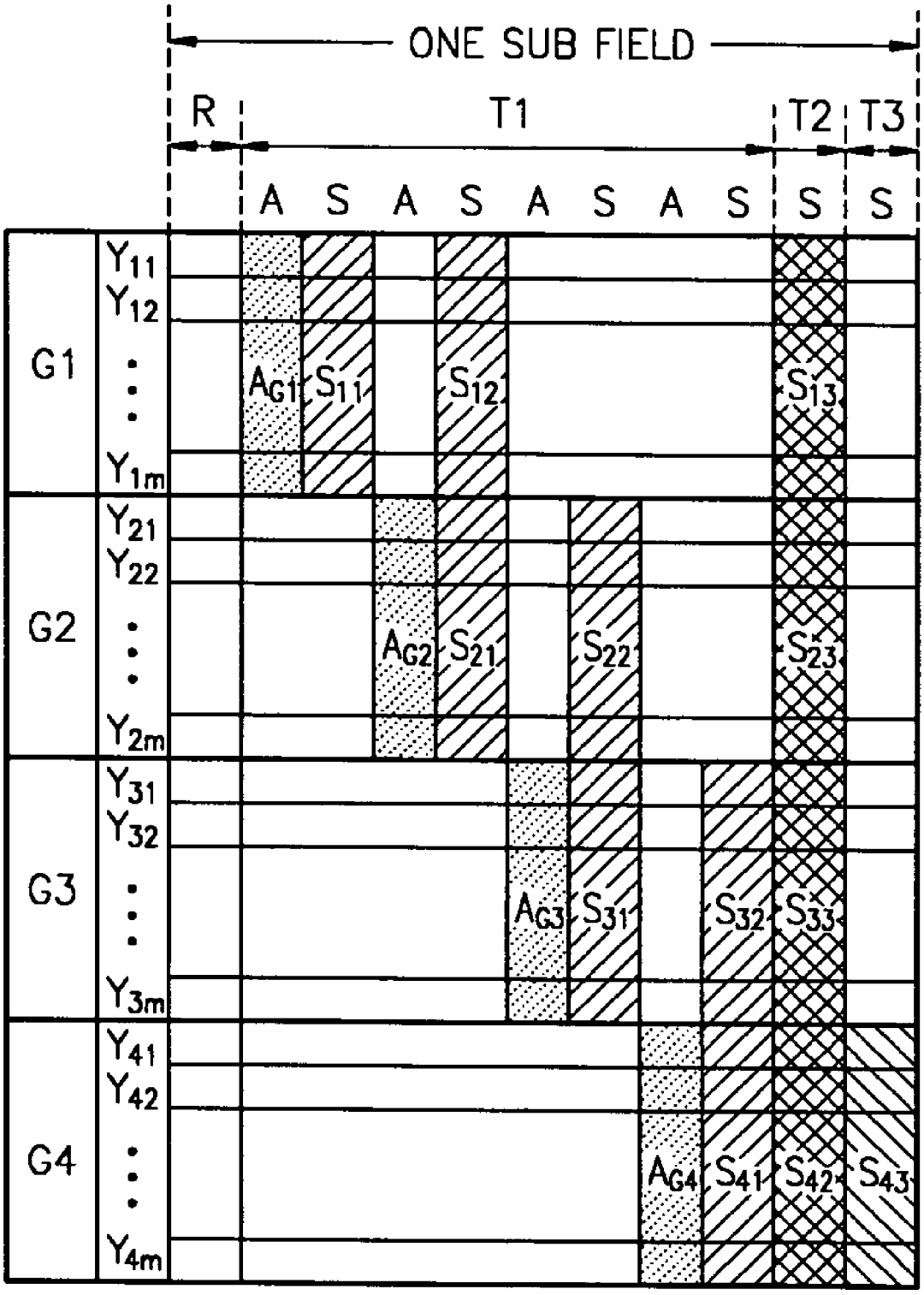
Figure 4C:
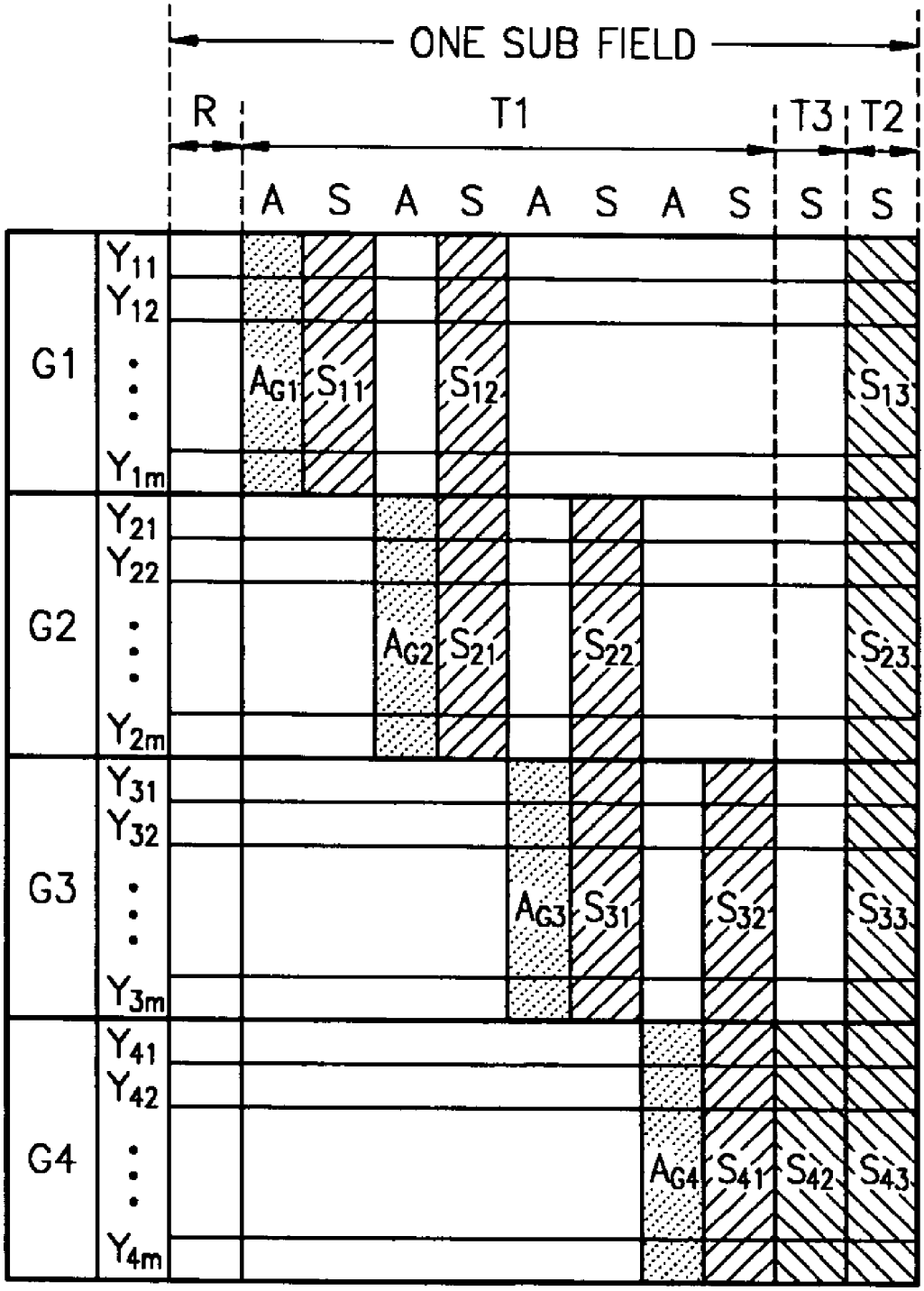
Figure 10:
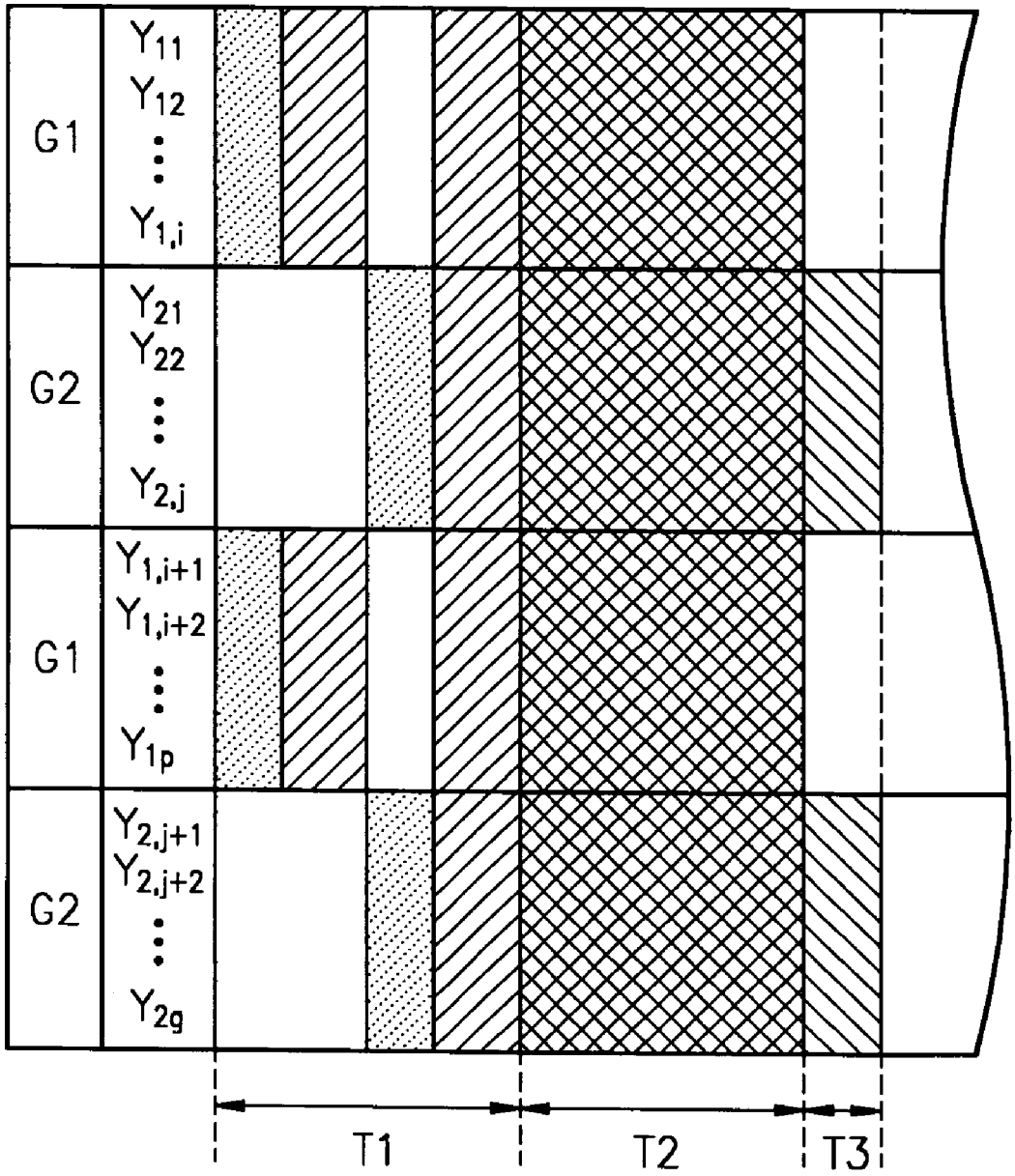
FIGS. 10, 11A, 11B, 12A and 12B illustrate different methods of grouping scan electrodes.

FIGS. 4A, 4B and 4C illustrate various embodiments of a panel driving method according to the present invention. If a maximum number of 90 sustain pulses are allocated to a sub-field, they can be divided to individual sustain periods in various ways for the embodiments of the panel driving method according to the present invention. If the pixels of a panel are divided into four groups and driven in the way of FIG. 3A, 10 sustain pulses are allocated to each of the sustain periods of the write/sustain mixed period T1, and 50 sustain pulses are allocated for a concurrent sustain period T2. In other words, 10*4 sustain pulses are allocated to a write/sustain mixed period T1 for the first group, and 50 sustain pulses are allocated to a concurrent sustain period T2 for the first group. 10*3 sustain pulses are allocated to a write/sustain mixed period T1 for the second group, 50 sustain pulses are allocated to a concurrent sustain period T2 for the second group, and 10 sustain pulses are allocated to a brightness compensation period T3 for the second group.

The number of sustain pulses applied to each of the sustain periods of the write/sustain mixed period T1 can be differently determined according to a design specification. If 30 sustain pulses are allocated to each of the sustain periods, the timing diagram of FIG. 4A is obtained.

During the write/sustain mixed period T1 for the first group, all of 90 sustain pulses can be applied through three sustain periods corresponding to address periods for the first group, the second group and the third group. Accordingly, while a sustain period is being performed subsequent to an address period of the fourth group, sustain pulses are not applied to the pixels of the first group. The third group undergoes sustain periods $S_{31}$ and $S_{32}$ in the write/sustain mixed period T1 and then must undergo an additional sustain period $S_{33}$ in order to match its brightness with the brightness levels of the first group and the second group. The fourth group operates in the same manner as described above.

As described above, FIG. 4A shows an example in which a sub-field comprises a write/sustain mixed period T1 and a brightness compensation period T3 without a concurrent sustain period. In this example, sustain pulses allocated to obtain a gradation for one sub-field must be applied to at least one group during the sustain periods included in the write/sustain mixed period T1.

FIG. 4A is a timing diagram illustrating a panel driving method in which the pixels of a panel are divided into a plurality of groups, and each of the groups is addressed and sustain-discharged to make pixels of each of the groups have a predetermined gradation. During the write/sustain mixed period T1, while a sustain period is performed on the pixels of a certain group, sustain periods are also performed on the pixels of other groups that have already been addressed. If a predetermined gradation is obtained during the sustain periods performed until now on a certain group, the group is in an idle state although other groups undergo sustain periods. After an address period and a sustain period are completely performed on the pixels of the last group, the groups that do not satisfy the predetermined gradation selectively undergo an additional sustain period.

FIG. 4B illustrates a panel driving method in which a sustain period $S_{13}$ for a first group, a sustain period $S_{23}$ for a second group, a sustain period $S_{33}$ for a third group, and a sustain period $S_{42}$ for a fourth group are performed at the same time. In this example, while a sustain period is performed on a certain group in a write/sustain mixed period T1, other groups that have already undergone address periods may or may not be subject to sustain periods. The numbers of sustain pulses allocated during each of the sustain periods included in the write/sustain mixed period T1 can be set to be completely equal to each other. Alternatively, some of the sustain periods are set to have an equal number of sustain pulses. Alternatively, all of the sustain periods are set to have different numbers of sustain pulses.

FIG. 4C illustrates a panel driving method where a write/sustain mixed period T1 is followed by a brightness compensation period T3, and a concurrent sustain period T2 is then performed.

Figure 5:
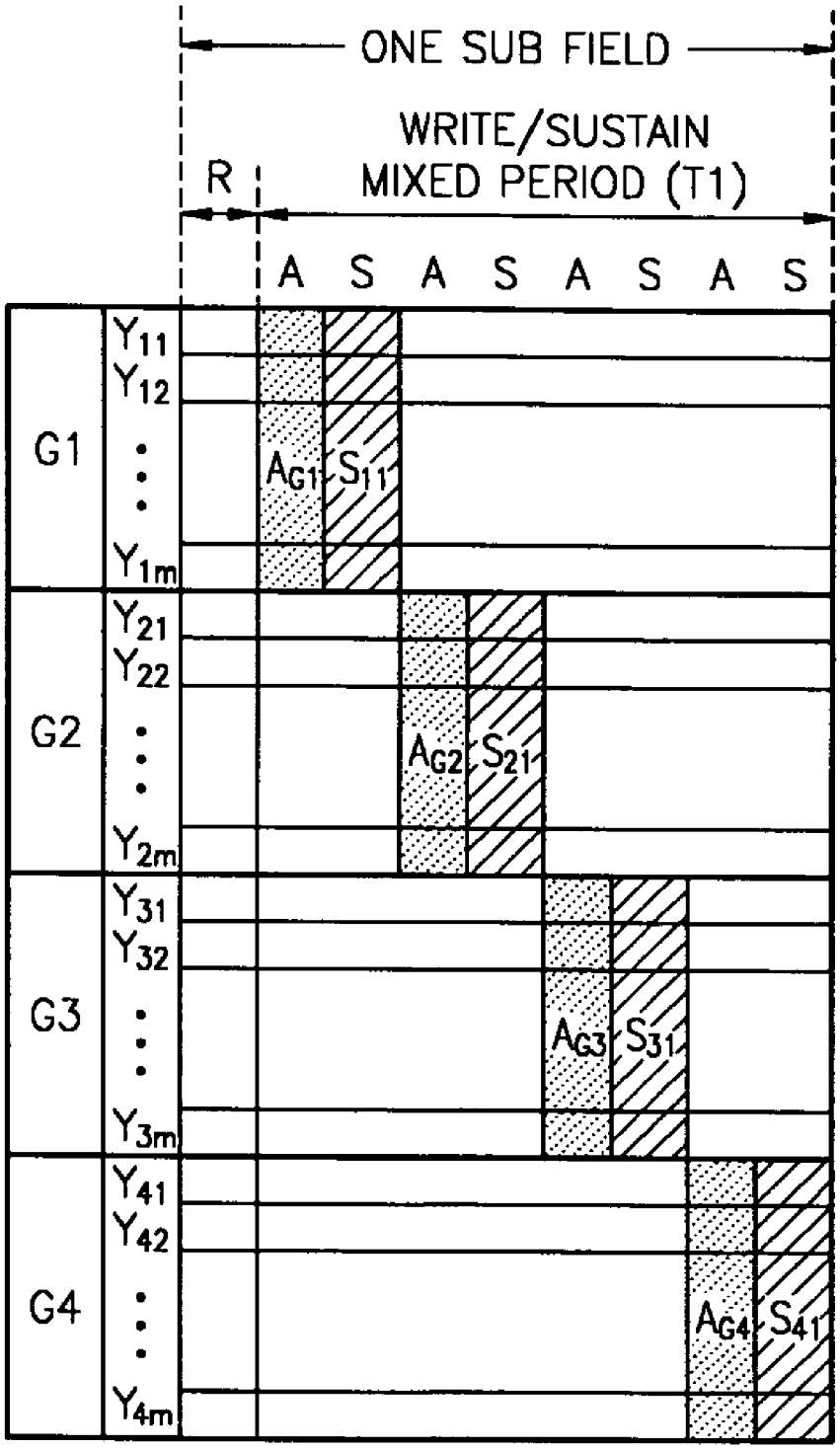
FIG. 5 is a timing diagram for illustrating a method for driving a display panel according to a second embodiment of the present invention.

FIG. 5 is a timing diagram for illustrating a method for driving a panel according to an embodiment of the present invention. An addressing operation is performed by sequentially applying address pulses to the scan electrodes of the first group. When all the scan electrodes of the first group has been completely addressed, a sustain operation is performed by applying sustain pulses to the scan electrodes.

Completing the sustain operation for the first group, an address operation and a sustain discharge operation are sequentially performed on the scan electrodes of the second group. In this way, all the groups undergo a sequence of an address period and a sustain period. The method for driving a panel according to an embodiment exemplified in FIG. 5 is useful, particularly when all of sustain pulses, the number of which is required to obtain a desired gradation, can be allocated during a single sustain period in a write/sustain mixed period T1. Accordingly, in this embodiment, an address period and a sustain period are sequentially performed on individual groups.

Figure 6A:
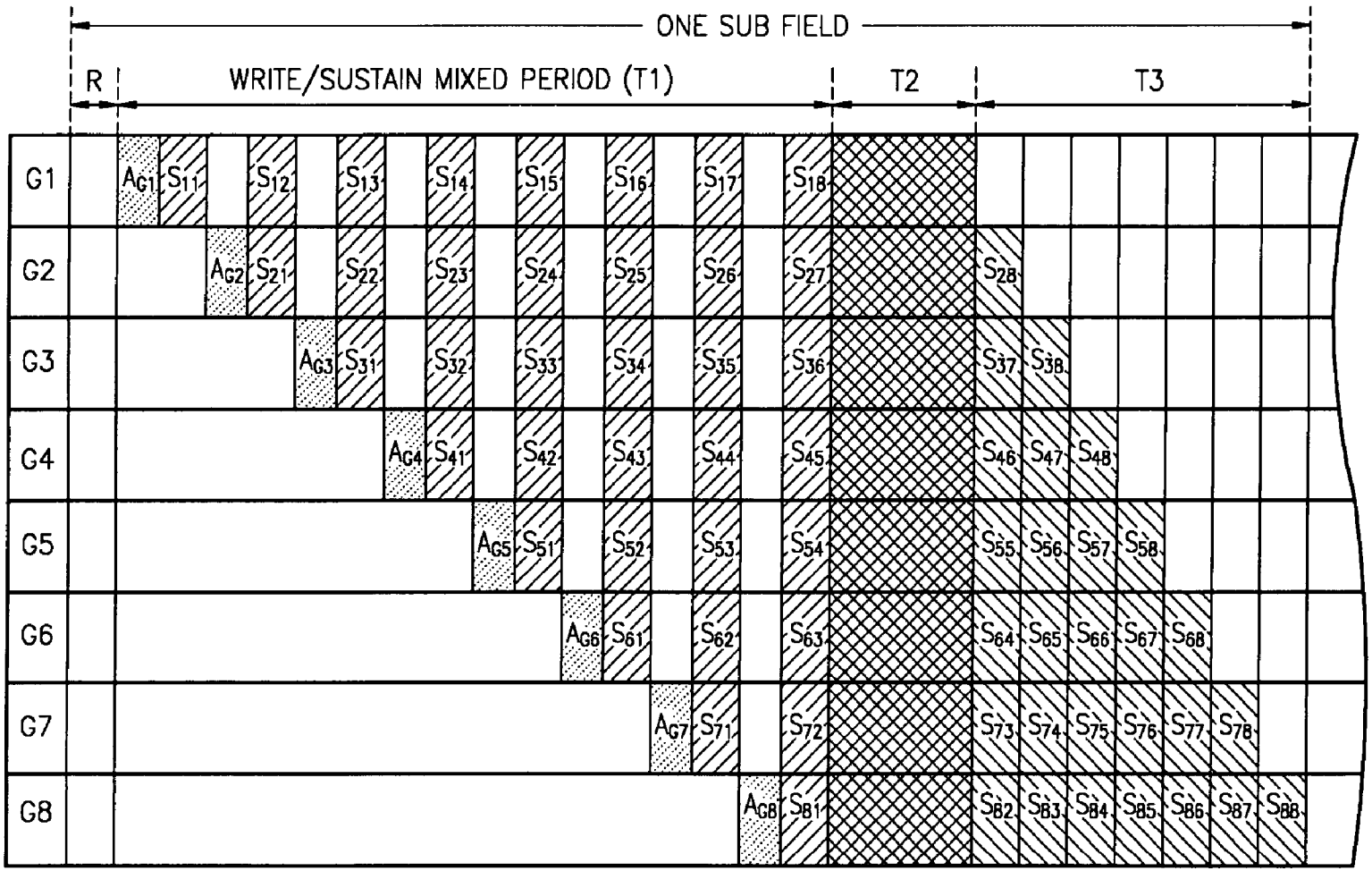
FIGS. 6A, 6B, and 6C illustrate various examples where a display panel has its pixels arranged into eight groups.
Figure 6B:
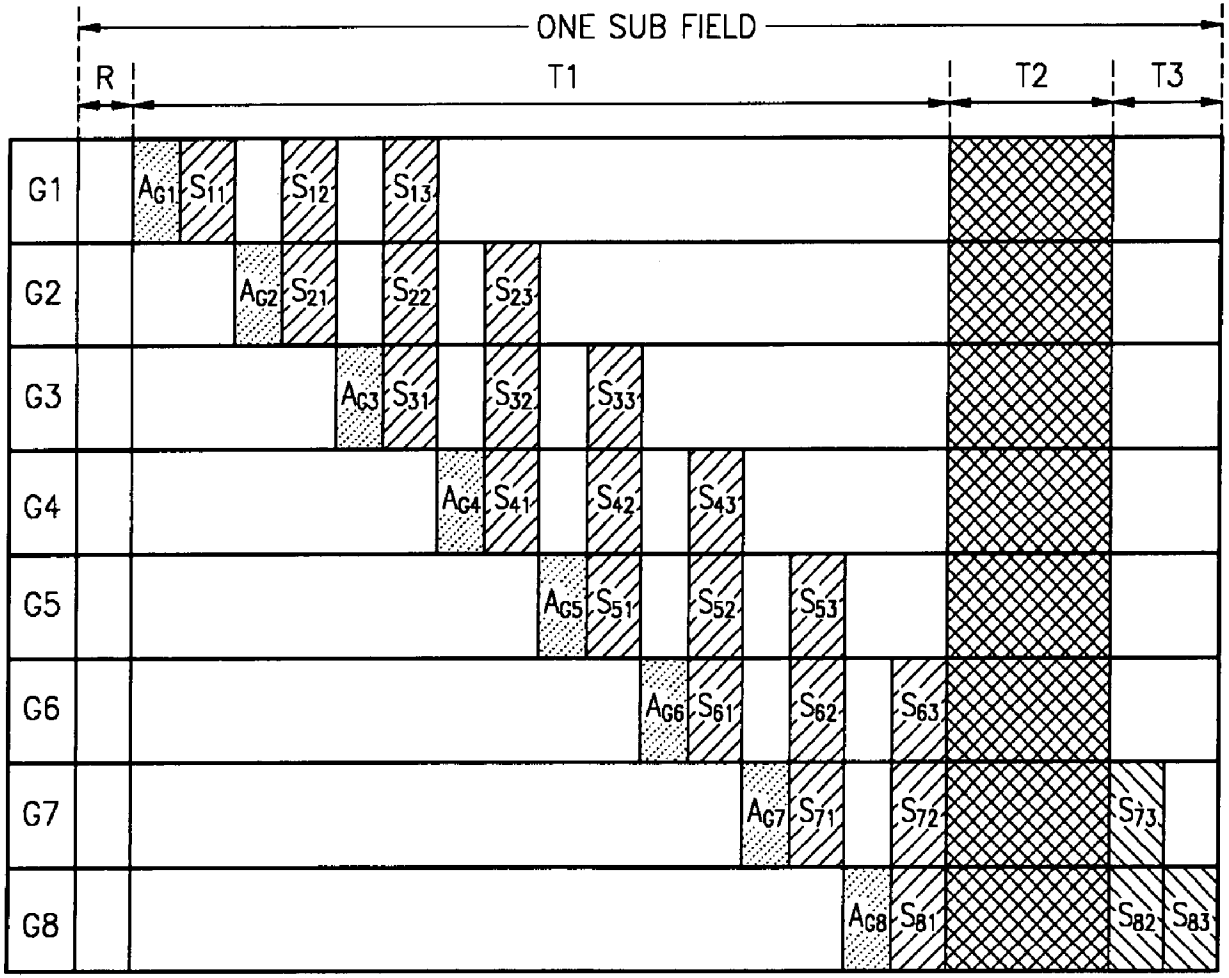
Figure 6C:
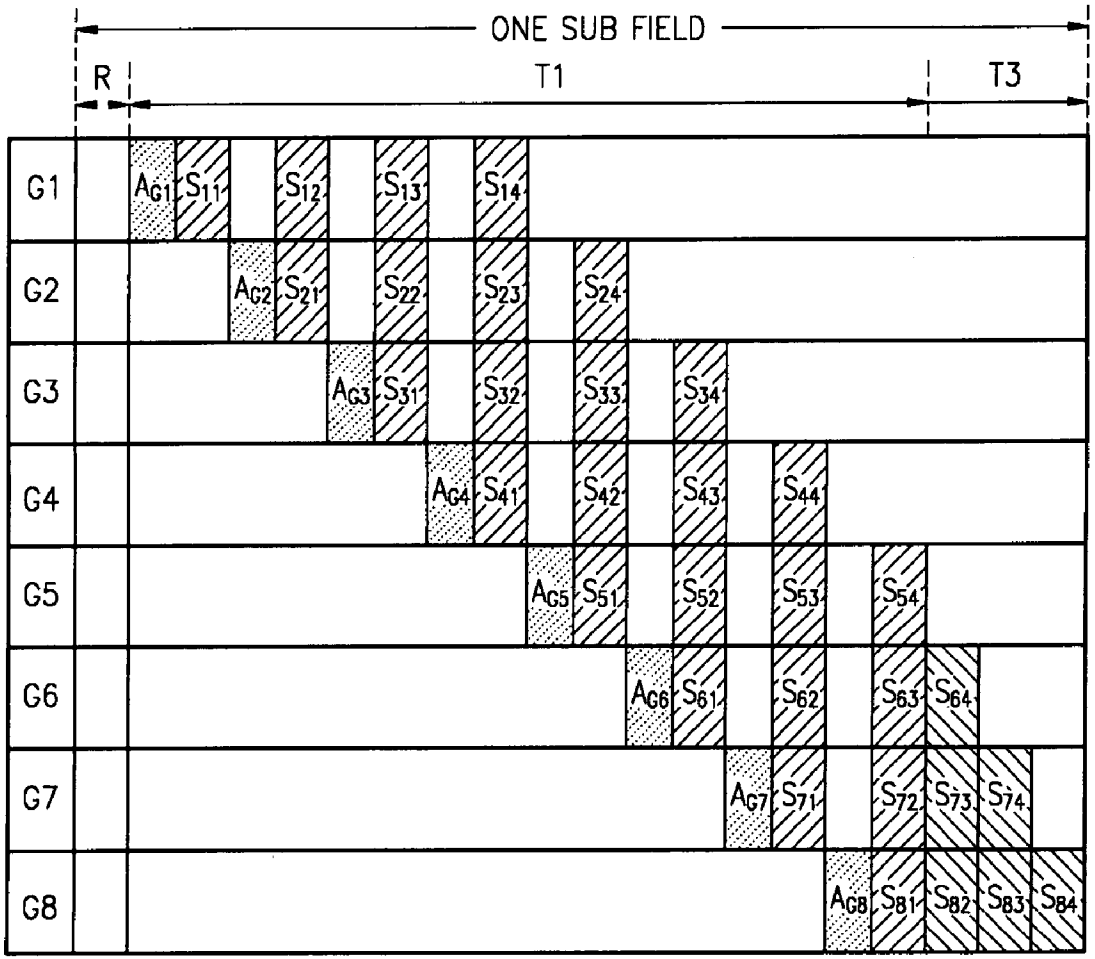

FIGS. 6A, 6B and 6C illustrate various examples in which a panel driving method according to the present invention is applied to 8 groups of pixels of a panel. FIG. 6A illustrates a panel driving method where a sub-field comprises a write/sustain mixed period T1, a concurrent sustain period T2, and a brightness compensation period T3. The panel driving method of FIG. 6A is substantially the same as the panel driving method of FIG. 3A.

In a method illustrated in FIG. 6B, during a write/sustain mixed period T1, while a sustain operation is being performed on a certain group, other groups that have already been addressed may also be subject to sustain operations. FIG. 6C illustrates a panel driving method in which a sub-field comprises a write/sustain mixed period T1 and a brightness compensation period T3.

In addition, the grouping can be dynamically changed. When the display panel receives different types of image signals, such as HDTV signal, conventional NTSC type signal, PAL type signal or SECAM type signal, the display device may change the number of groups. The grouping can be changed for any other reasons. User may want different resolution for the display or may have special needs for different purposes. Detecting the different signals and changing the groups are well known to one of ordinary skills in the art.

Figure 11A:
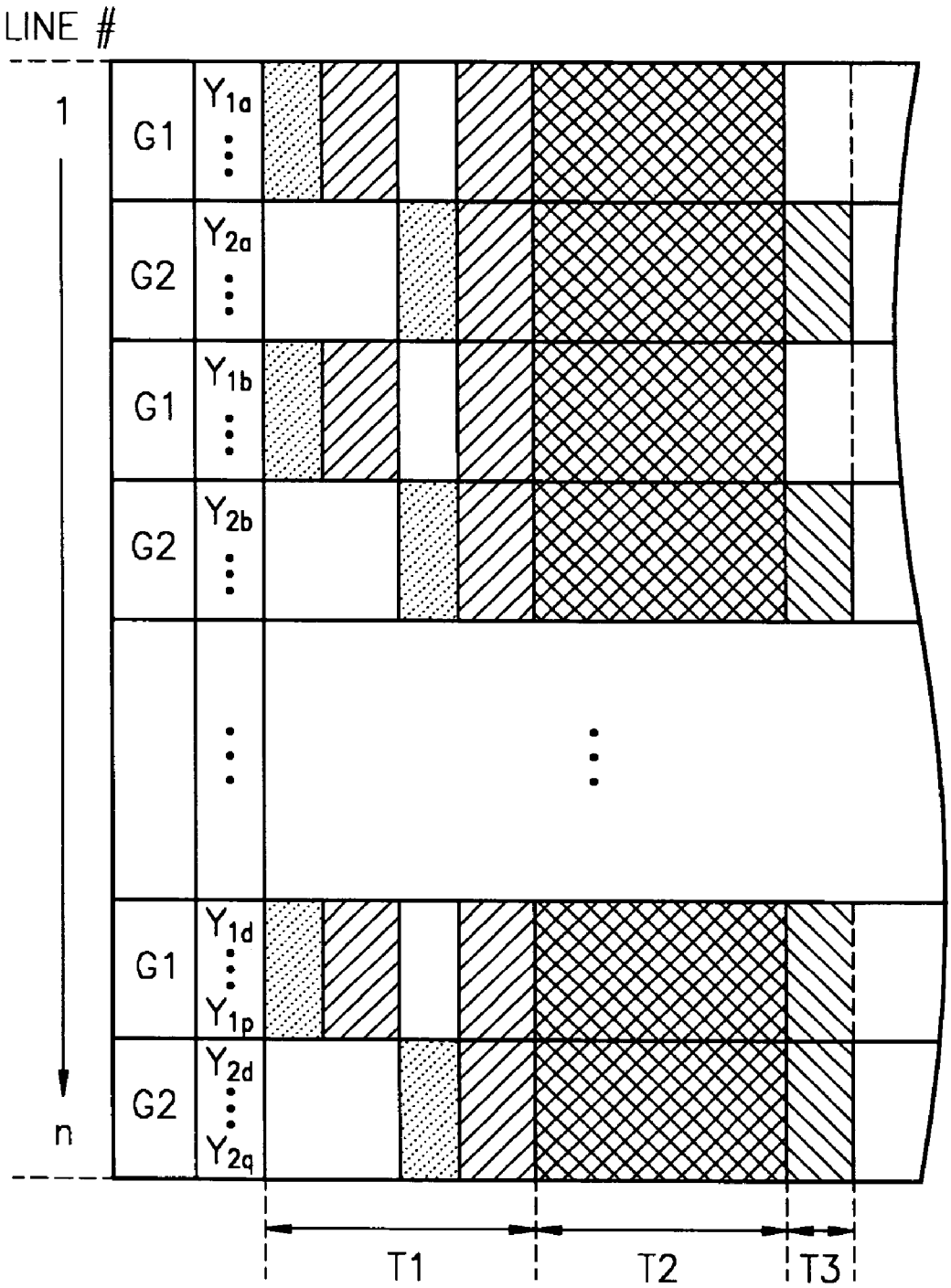
Figure 11B:
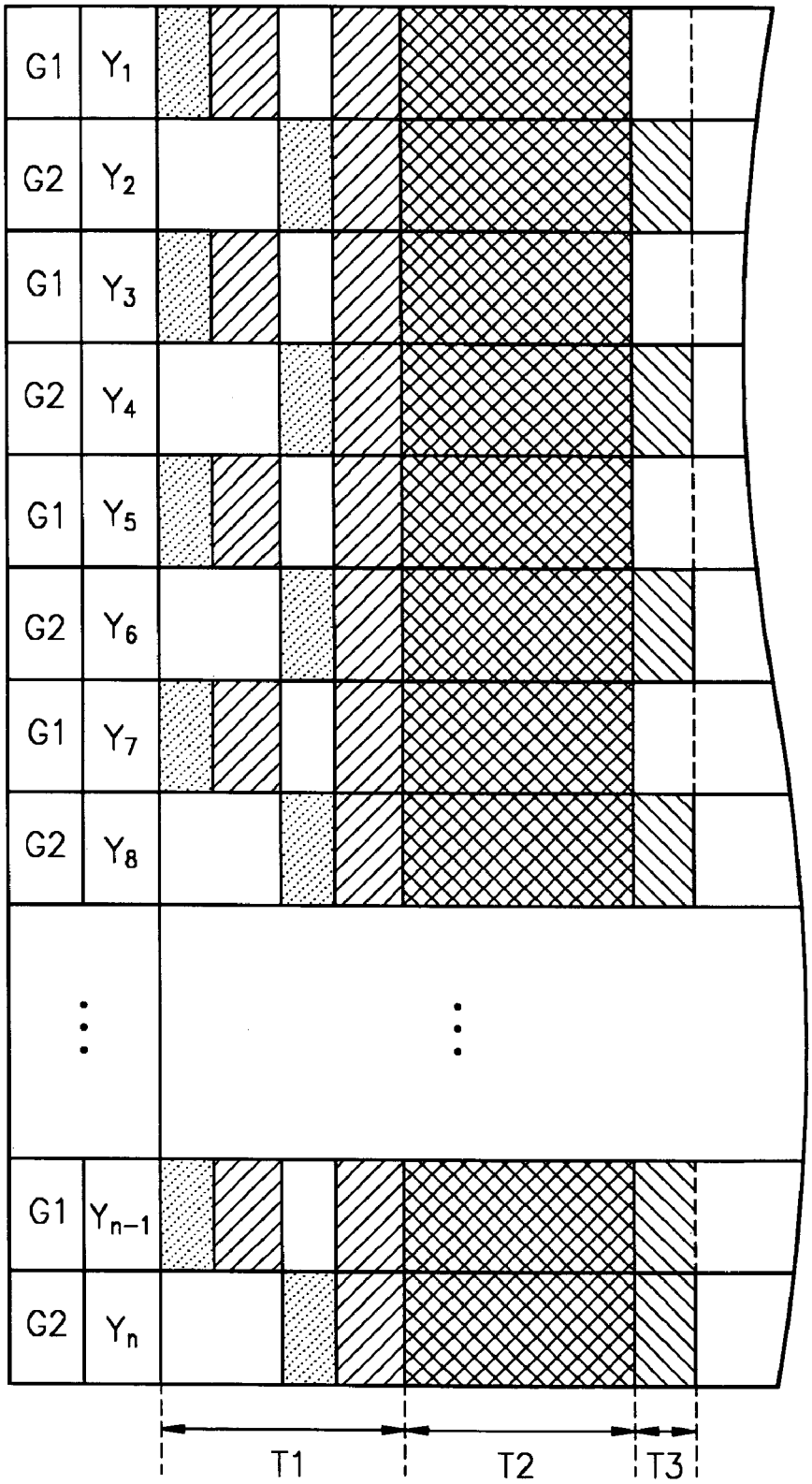
Figure 12A:
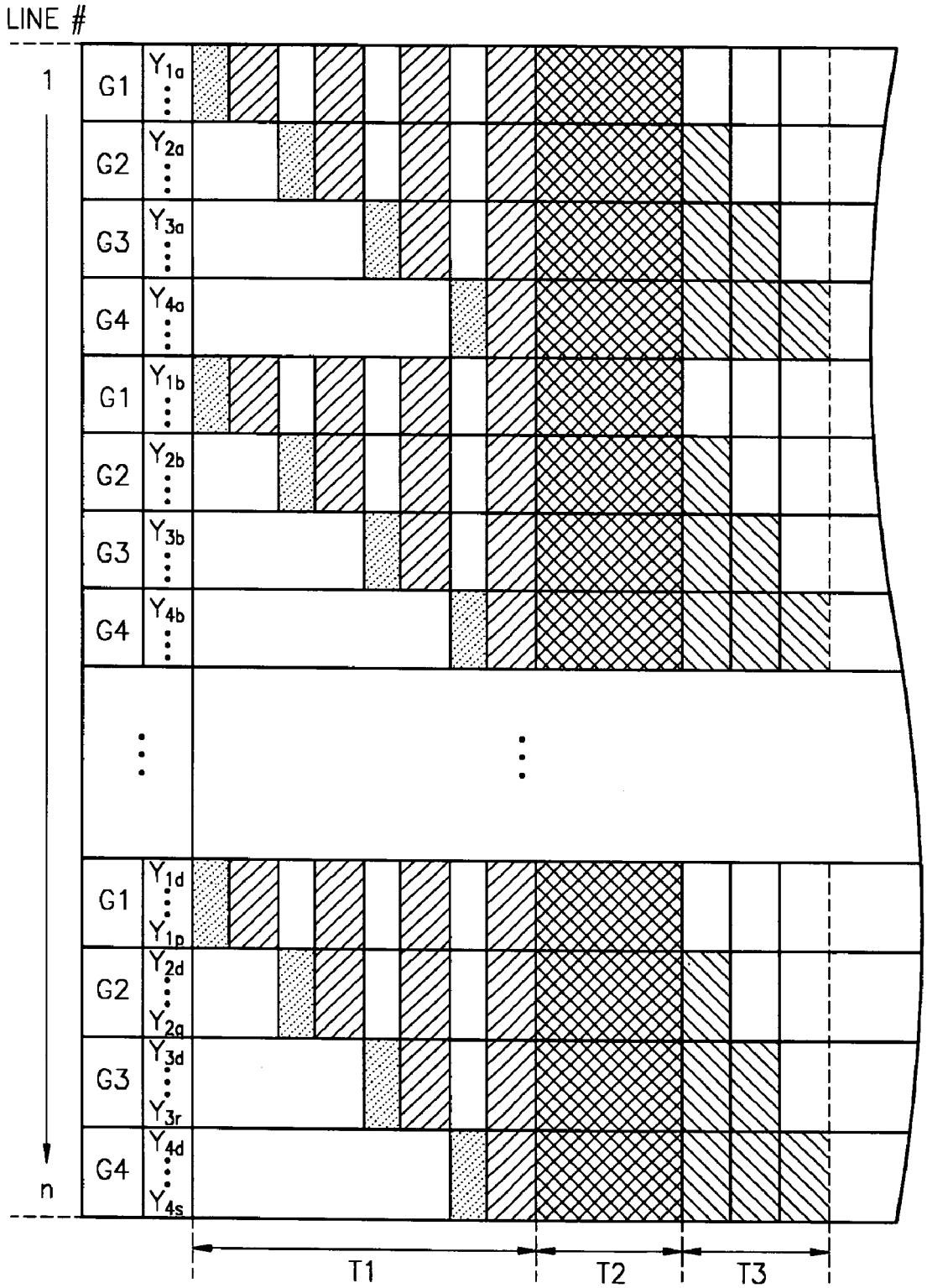
Figure 12B:
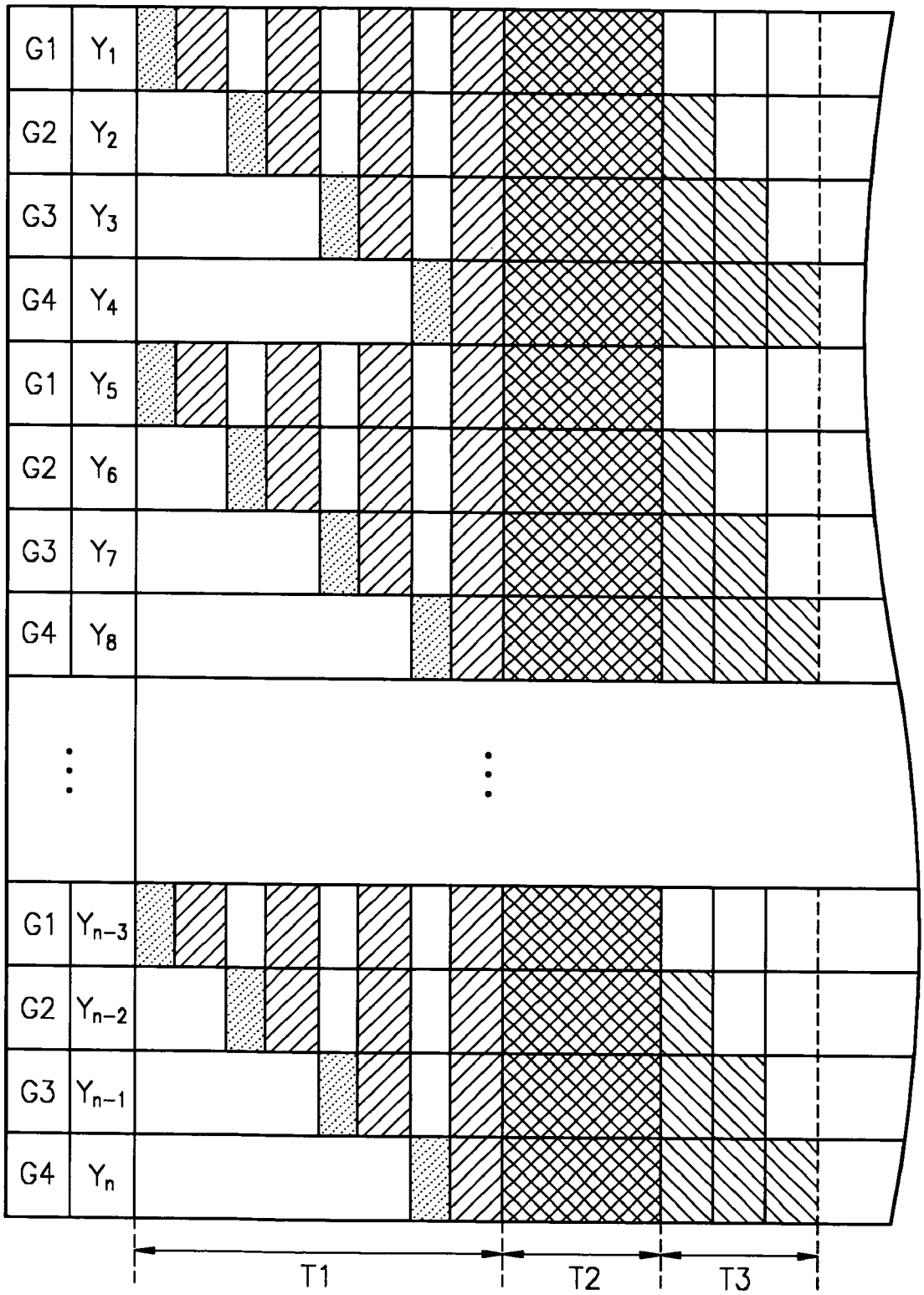

During the grouping period, various combinations of grouping scheme can be used. FIGS. 1A and 1B show one example of grouping methods. The scan electrodes are grouped by their sequential order. In other words, the first m lines form a first group and the second m lines form a second group, and so on. Or every $n^{th}$ line can form one group and every $(n+j)^{th}$ line can form another group, as illustrated in FIGS. 11A, 11B, 12A and 12B. FIG. 11B shows an example in which every other line forms G1 and G2. All the pixels in group G1 are addressed and sustain discharged at the same time and then all the pixels in group G2 are addressed and sustain discharged. FIG. 12B shows an example that every $1^{st}$, $2^{nd}$, $3^{rd}$ and $4^{th}$ line form a separate group respectively. In other words, $1^{st}$ line, $5^{th}$ line, $9^{th}$ line, . . . form a first group G1. The $2^{nd}$ line, line, $10^{th}$ line, . . . , form a second group G2. The $3^{rd}$ line, $7^{th}$ line, $11^{th}$ line, . . . form a third Finally, the $4^{th}$ line, $8^{th}$ line, $12^{th}$ line, . . . form a fourth group G4. Pixels of each group are all simultaneously addressed and sustain-discharged. However, all the groups are not addressed and sustain-discharged at the same time.

Each grouping should not be limited by line by line. Each $1^{st}$ line or $2^{nd}$ line could be replaced with group of lines of same number or different numbers. Such examples are illustrated in FIGS. 11A and 12A. There are many other ways to implement the groupings and the present invention is not limited to those as exemplified over here. FIG. 9 is a block diagram of a panel driving apparatus that implements the above-described method for driving a panel. In the pulse synthesis unit 94 and the Y driver 96, address and sustain operations according to the present invention are performed on the pixels of the panel 97.

The panel driving apparatus according to the present invention addresses and sustain-discharges the pixels of each of a plurality of groups into which the pixels of the panel 97 are divided. The pulse synthesis unit 94 generates an address signal and a sustain signal so that an address operation and a sustain operation are sequentially performed on the pixels in each of the groups. While addressing the pixels of a certain group, the pixels of other groups remain idle. While a sustain operation is performed after addressing the group, groups that have already been addressed are selectively subject to sustain periods.

The Y driver 96 performs an address operation by applying scan pulses to the scan electrodes of individual groups and simultaneously applying address pulses to address electrodes. It also performs a sustain operation by applying sustain pulses to the scan electrodes. Thus, address periods and sustain periods exist together. The X driver 95 applies sustain pulses to sustain electrodes while performing a sustain operation on the pixels of each of the groups.

The pulse synthesis unit 94 may also generate a sustain signal used to perform a predetermined length of a sustain period concurrently on the pixels of all the groups after the pixels of all the groups have been addressed, in order to perform a concurrent sustain period. The pulse synthesis unit 94 may also generate a sustain signal that selectively performs an additional sustain operation on the pixels of each of the groups so that each of the groups satisfies a predetermined gradation. Thus, the pulse synthesis unit also may perform a brightness compensation period.

Preferably, while an address operation and a sustain operation are sequentially performed on individual groups, if the predetermined gradation is obtained at a certain group, the pixels of the group are maintained in an idle state although other groups undergo sustain periods.

It is preferable that the pixels of all groups are reset concurrently before the pixels of the first group are addressed. Alternatively, a reset period may be performed on the pixels of each group before the group undergoes an address period.

As described above, in the embodiments of the present invention, the pixels of a panel are divided into a plurality of groups, and an address operation and a sustain operation are sequentially performed on the pixels of each of the groups. While an address operation is performed on the pixels of a certain group, the pixels of other groups are idle. While a sustain operation is performed on the pixels of a certain group after an address operation, sustain operations are selectively performed on the pixels of groups that have already been addressed. Each of the first through n-th groups has selectively undergone a sustain period between adjacent address periods.

The above-described methods for driving panel electrodes according to the present invention are all applicable to display devices that sequentially perform an address period for previously selecting a cell to be lit and a sustain operation for lighting the selected cell. For example, it is apparent to those skilled in the art that the technical spirit of the present invention can be applied to display devices that display a picture by sequentially performing an address operation and a sustain operation, such as, AC-type PDPs, DC-type PDPs, EL display devices, or liquid crystal displays (LCDs).

The invention can also be embodied as computer readable codes on a computer readable recording medium. The computer readable recording medium is any data storage device that can store programs or data which can be thereafter read by a computer system. Examples of the computer readable recording medium include read-only memory (ROM), random-access memory (RAM), CD-ROMs, magnetic tapes, hard disks, floppy disks, flash memory, optical data storage devices, and so on. Here, a program stored in a recording medium is expressed in a series of instructions used directly or indirectly within a device with a data processing capability, such as, computers. Thus, a term "computer" involves all devices with data processing capability in which a particular function is performed according to a program using a memory, input/output devices, and arithmetic logics. For example, a panel driving apparatus can be considered a computer for performing a panel driving operation.

The pulse synthesis unit 94 included in the panel driving apparatus may be implemented by an integrated circuit including a memory and a processor, thus the pulse synthesis unit 94 can store a program for executing a panel driving method in the memory. When a panel is driven, the program stored in the memory is executed to perform addressing and sustaining operations according to the present invention. Therefore, an integrated circuit storing a program for executing a method for driving a panel can be interpreted as any of the above-enumerated recording media.

While the present invention has been particularly shown and described with reference to exemplary embodiments thereof, it will be understood by those of ordinary skill in the art that various changes in form and details may be made therein without departing from the spirit and scope of the present invention as defined by the following claims.

As described above, a method and an apparatus for driving a panel according to the present invention divides the pixels of a panel into a plurality of groups, and a sequence of an address operation and a sustain operation is repeatedly performed on each of the groups. In other words, a sustain discharge operation is performed within a short period of time after addressing each group of the pixels. This stabilizes the sustain discharge even though narrow scan pulses and address pulses may be applied during the address operation. Accordingly, the present invention reduces the time required to address all pixels, making it possible to allocate longer time to perform a sustain discharge during one TV field. Therefore, the screen brightness is improved, and a large panel with many scan lines can represent a higher gradation.

What is claimed is:

1. A method for driving a display panel, wherein pixels of the display panel are arranged into m groups, the method comprising steps of:

in a write/sustain mixed period, addressing the pixels of $(n)^{th}$ group;

sustain-discharging the $(n)^{th}$ group;

addressing the pixels of $(n+1)^{th}$ group; and sustain-discharging the $(n+1)^{th}$ group, wherein n is a natural number and less than m, and a group among groups already addressed is sustain-discharged when sustain-discharging the $(n+1)^{th}$ group.

2. The method of claim 1, wherein the group among groups already addressed is sustain-discharged for a certain number of periods when sustain-discharging the $(n+1)^{th}$ group.

3. A method for driving a display panel, wherein pixels of the display panel are arranged into m groups, the method comprising steps of:

in a write/sustain mixed period, addressing the pixels of $(n)^{th}$ group;

sustain-discharging the $(n)^{th}$ group;

addressing the pixels of $(n+1)^{th}$ group; and sustain-discharging the $(n+1)^{th}$ group;

in a bright compensation period, sustain-discharging selected groups; and in a concurrent sustain period, sustain-discharging all the groups concurrently, wherein n is a natural number and less than m, and the concurrent sustain period precedes or follows the brightness compensation period.

* * * * *